US008974994B2

(12) United States Patent
Kamae et al.

(10) Patent No.: US 8,974,994 B2
(45) Date of Patent: Mar. 10, 2015

(54) MAGNETIC CARRIER, TWO-COMPONENT DEVELOPER, AND DEVELOPER FOR REPLENISHMENT

(71) Applicant: Canon Kabushiki Kaisha, Tokyo (JP)

(72) Inventors: Kentaro Kamae, Yokohama (JP); Koh Ishigami, Mishima (JP); Yoshinobu Baba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/752,129

(22) Filed: Jan. 28, 2013

(65) Prior Publication Data

US 2013/0196265 A1 Aug. 1, 2013

(30) Foreign Application Priority Data

Jan. 31, 2012 (JP) ..... 2012-017702

(51) Int. Cl.
*G03G 9/08* (2006.01)
*G03G 9/107* (2006.01)
*G03G 9/113* (2006.01)

(52) U.S. Cl.
CPC ..... *G03G 9/1075* (2013.01); *G03G 9/1133* (2013.01); *G03G 9/1139* (2013.01)
USPC ..... 430/111.35

(58) Field of Classification Search
CPC ..... G03G 9/1075; G03G 9/1139
USPC ..... 430/111.35
See application file for complete search history.

(56) References Cited

U.S. PATENT DOCUMENTS

| | | | | |
|---|---|---|---|---|
| 5,340,677 | A | | 8/1994 | Baba et al. |
| 5,439,771 | A | | 8/1995 | Baba et al. |
| 5,464,720 | A | | 11/1995 | Baba et al. |
| 5,470,687 | A | | 11/1995 | Mayama et al. |
| 5,494,770 | A | | 2/1996 | Baba et al. |
| 5,573,880 | A | | 11/1996 | Mayama et al. |
| 5,576,133 | A | | 11/1996 | Baba et al. |
| 5,712,069 | A | | 1/1998 | Baba et al. |
| 5,744,278 | A | | 4/1998 | Ayaki et al. |
| 5,766,814 | A | | 6/1998 | Baba et al. |
| 5,789,132 | A | | 8/1998 | Mayama et al. |
| 5,985,502 | A | | 11/1999 | Ayaki et al. |
| 5,998,076 | A | * | 12/1999 | Mahabadi et al. ..... 430/111.32 |
| 6,010,811 | A | | 1/2000 | Baba et al. |

(Continued)

FOREIGN PATENT DOCUMENTS

| | | | |
|---|---|---|---|
| JP | 2010-102190 | A | 5/2010 |
| JP | 2011-33861 | A | 2/2011 |

*Primary Examiner* — Mark A Chapman
(74) *Attorney, Agent, or Firm* — Fitzpatrick, Cella, Harper and Scinto

(57) ABSTRACT

Provided is a magnetic carrier satisfactory in terms of the suppression of leakage and solid carrier adhesion, charge-providing performance, and developability. The magnetic carrier is a magnetic carrier, including filled core particles of which pores of porous magnetic core particles are filled with a filling resin composition, and having a surface coated with a coating resin composition, in which the coating resin composition comprises a coating resin and a carbon black, an amount of the coating resin composition is 2.0 parts by mass or more and 5.0 parts by mass or less with respect to 100.0 parts by mass of the filled core particles; and a particle diameter of the carbon black in the coating resin composition Pv at a maximum frequency in a particle size distribution based on a volume of the carbon black is 1.0 μm or more and 10.0 μm or less.

5 Claims, 4 Drawing Sheets

(56) References Cited

U.S. PATENT DOCUMENTS

| | | | |
|---|---|---|---|
| 6,083,655 | A | 7/2000 | Itabashi et al. |
| 6,106,990 | A | 8/2000 | Tazawa et al. |
| 6,124,070 | A | 9/2000 | Baba et al. |
| 6,159,648 | A | 12/2000 | Baba et al. |
| 6,165,663 | A | 12/2000 | Baba et al. |
| 6,358,658 | B1 | 3/2002 | Tazawa et al. |
| 6,566,028 | B2 | 5/2003 | Tazawa et al. |
| 7,138,213 | B2 | 11/2006 | Itakura et al. |
| 7,144,668 | B2 | 12/2006 | Baba et al. |
| 7,244,539 | B2 | 7/2007 | Baba et al. |
| 7,279,262 | B2 | 10/2007 | Fujikawa et al. |
| 7,288,348 | B2 | 10/2007 | Hayami et al. |
| 7,396,626 | B2 | 7/2008 | Fujikawa et al. |
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,767,370 | B2 | 8/2010 | Ishigami et al. |
| 7,858,283 | B2 | 12/2010 | Ishigami et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,142,972 | B2 | 3/2012 | Hotta et al. |
| 8,298,742 | B2 | 10/2012 | Okamoto et al. |
| 8,323,726 | B2 | 12/2012 | Naka et al. |
| 2003/0104303 | A1* | 6/2003 | Mahabadi et al. ..... 430/111.32 |
| 2010/0028796 | A1 | 2/2010 | Nakamura et al. |
| 2010/0183971 | A1 | 7/2010 | Fujikawa et al. |
| 2010/0248126 | A1 | 9/2010 | Ishigami et al. |
| 2010/0273103 | A1 | 10/2010 | Baba et al. |
| 2010/0310978 | A1 | 12/2010 | Endo et al. |
| 2011/0097661 | A1 | 4/2011 | Ishigami et al. |
| 2012/0094225 | A1 | 4/2012 | Ishigami et al. |
| 2012/0214097 | A1 | 8/2012 | Naka et al. |
| 2013/0171556 | A1 | 7/2013 | Fujikawa et al. |

* cited by examiner

MAGNETIC CARRIER, TWO-COMPONENT DEVELOPER, AND DEVELOPER FOR REPLENISHMENT

BACKGROUND OF THE INVENTION

1. Field of the Invention

The present invention relates to a magnetic carrier to be used in an image-forming method for visualizing an electrostatic image by employing an electrophotographic method, and to a two-component developer using the carrier.

2. Description of the Related Art

In general, the following method has heretofore been employed as an image-forming method of an electrophotographic system. An electrostatic latent image is formed on an electrostatic latent image-bearing member with various processes and then toner is caused to adhere to the electrostatic latent image to develop the electrostatic latent image. At the time of the development, the following two-component development system has been widely adopted. A carrier particle called a magnetic carrier is mixed with the toner, the toner is provided with a proper quantity of positive or negative charge by subjecting the mixture to triboelectric charging, and the development is performed with the charge as a driving force.

The two-component development system has an advantage such as good controllability of the performance of a developer because of the following reason. The system can impart functions such as the stirring, conveyance, and charging of the developer to the magnetic carrier, and hence functions are clearly shared between the carrier and the toner.

Meanwhile, in association with the evolution of a technology in the field of electrophotography, not only an increase in speed of an apparatus and the lengthening of its lifetime but also an improvement in definition of an image formed with the apparatus and the stabilization of the quality of the image have started to be required more and more strictly in recent years.

In view of the foregoing, in Japanese Patent Application Laid-Open No. 2011-33861, an attempt has been made to improve the developability of a magnetic carrier and the following magnetic carrier has been proposed. Conductive fine particles are added to the surface of the magnetic carrier to reduce the surface resistance of the magnetic carrier. Although the reduction of the resistance achieves the improvement of the developability, the reduction causes the following problem of leakage in some cases. Charge is injected into an electrostatic image from a developer carrying member through the magnetic carrier to disturb the electrostatic image. In addition, in some cases, the reduction causes the so-called solid carrier adhesion in which the magnetic carrier becomes identical in polarity to toner and hence the magnetic carrier as well as the toner adheres to the image portion of an electrostatic latent image-bearing member.

Meanwhile, Japanese Patent Application Laid-Open No. 2010-102190 proposes an increase in thickness of a coating resin layer and the formation of a two-layer coating resin that lead to the suppression of the leakage and fogging.

The magnetic carrier can suppress the leakage and the fogging. However, increasing the thickness of the coating resin layer tends to be liable to cause the coalescence of particles of the magnetic carrier. When a coalesced magnetic carrier exists, the coalesced magnetic carrier is typically removed by sieving. However, when the coalesced magnetic carrier is shredded by the impact of the sieving, a magnetic carrier having a crater-like shredded surface passes a sieve to be mixed into a product in some cases. When image output is performed with such magnetic carrier for a long time period, the external additive of the toner is selectively accumulated in the crater portion of the magnetic carrier. Accordingly, the charge-providing performance of the magnetic carrier is impaired and hence a fluctuation in color occurs in some cases. In addition, the resistance of the magnetic carrier increases owing to the increased thickness of the coating resin layer, and hence its developability reduces and an image density reduces in some cases.

As can be seen from the foregoing, it has been urgently needed to develop a magnetic carrier satisfactory in terms of the suppression of leakage and solid carrier adhesion, charge-providing performance, and developability.

SUMMARY OF THE INVENTION

An object of the present invention is to provide a magnetic carrier which has solved such problems as described above and with which a high-definition image can be stably formed. Specifically, the object is to provide a magnetic carrier satisfactory in terms of the suppression of leakage and solid carrier adhesion, charge-providing performance, and developability.

The inventors of the present invention have made extensive studies, and as a result, have found that a magnetic carrier satisfactory in terms of the suppression of leakage and solid carrier adhesion, charge-providing performance, and developability can be obtained by using the following magnetic carrier.

According to an exemplary embodiment of the present invention, provided is a magnetic carrier, including filled core particles of which pores of porous magnetic core particles are filled with a filling resin composition, and having a surface coated with a coating resin composition, in which the coating resin composition comprises a coating resin and a carbon black, an amount of the coating resin composition covering the surface of the filled core particles is 2.0 parts by mass or more and 5.0 parts by mass or less with respect to 100.0 parts by mass of the filled core particles; and a particle diameter of the carbon black in the coating resin composition covering the surface of the filled core particles Pv at a maximum frequency in a particle size distribution based on a volume of the carbon black is 1.0 μm or more and 10.0 μm or less.

Further, according to an exemplary embodiment of the present invention, provided is a two-component developer, including a magnetic carrier; and a toner, in which the toner has toner particles, each of which contains at least a binding resin, a coloring agent, and a wax, and inorganic fine powders; and the magnetic carrier includes the magnetic carrier of the above constitution.

Further, according to an exemplary embodiment of the present invention, provided is a developer for replenishment, including a magnetic carrier and a toner, the developer for replenishment being used in an image-forming method including performing image formation while replenishing a developing unit with the developer for replenishment as required and discharging the magnetic carrier that becomes excessive in the developing unit from the developing unit as required, in which the developer for replenishment contains 2.0 parts by mass or more and 50.0 parts by mass or less of the toner with respect to 1.0 part by mass of the magnetic carrier; the toner has toner particles, each of which contains at least a binding resin, a coloring agent, and a wax, and inorganic fine powders; and the magnetic carrier includes the magnetic carrier of the above constitution.

Further features of the present invention will become apparent from the following description of exemplary embodiments with reference to the attached drawings.

DESCRIPTION OF THE EMBODIMENTS

Figure 1A:
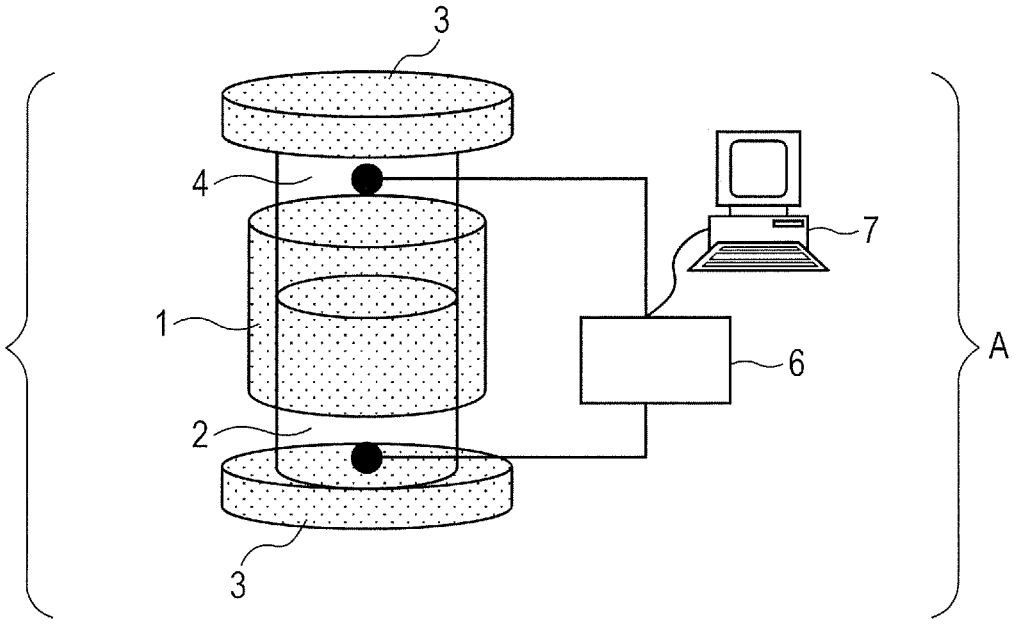
FIG. 1A is a schematic view of an apparatus for measuring the specific resistances of porous magnetic core particles, filled core particles, and a magnetic carrier used in the present invention.

A magnetic carrier of the present invention is a magnetic carrier including filled core particles obtained by filling the pores of porous magnetic core particles with a thermosetting resin composition, the filled core particles each having a surface coated with a coating resin composition containing a coating resin and a carbon black, in which the content of the coating resin composition is 2.0 parts by mass or more and 5.0 parts by mass or less with respect to 100.0 parts by mass of the filled core particles; and a particle diameter Pv showing the maximum frequency in the particle size distribution based on a volume of the carbon black in a toluene solution of the coating resin composition obtained by dispersing the magnetic carrier in toluene is 1.0 μm or more and 10.0 μm or less.

As described above, the coalescence of particles of the magnetic carrier is liable to occur owing to an increase in thickness of a coating resin composition layer. In addition, when the coalesced particle is shredded in a subsequent step, a magnetic carrier having a crater-like shredded surface occurs. When image output is performed with such magnetic carrier for a long time period, the external additive of toner is selectively accumulated in the crater portion of the magnetic carrier and hence the charge-providing performance of the magnetic carrier is impaired. As a result, in image formation involving using such magnetic carrier, a fluctuation in color of an image to be obtained enlarges. Further, the resistance of the magnetic carrier increases and hence an electrode effect is reduced. Accordingly, its developability reduces and the density of the image reduces in some cases.

In view of the foregoing, the inventors of the present invention have made investigations and have found that to control the irregular shapes characteristic of the porous magnetic core particles and the agglomeration property of the carbon black is important for preventing the coalescence of the particles of the magnetic carrier and suppressing the reduction of its developability. Thus, the inventors have reached the present invention.

The inventors of the present invention have paid attention to the manner in which the surface tension of the coating resin composition acts as a cause for the coalescence of the particles of the magnetic carrier. It is assumed that when the surface tension of the coating resin composition acts on each of the magnetic carrier particles and hence each particle forms a spherical particle, the coalescence does not occur, but when the surface tension of the coating resin composition acts between multiple magnetic carrier particles, the coalescence of the particles of the magnetic carrier occurs. In view of the foregoing, the inventors of the present invention have considered that it is important to cause the surface tension of the coating resin composition to act on each of the magnetic carrier particles.

To this end, it is important to form irregular shapes in the surfaces of the magnetic core particles to increase their areas of contact with the coating resin composition, and hence the porous magnetic core particles are suitably used. That is because of the following reason. The surfaces of a porous magnetic core particle are present on both sides of the coating resin composition that is present in a recessed portion of the porous magnetic core particle, and hence the surfaces of the porous magnetic core particle on both sides each serve as a bridge to make it easy for the surface tension of the coating resin composition to act.

In addition, when the magnetic core particles are turned into the porous magnetic core particles, the irregular shapes are formed in the surfaces of the magnetic core particles and hence the developability improves. The reason why the developability improves is as described below. The irregular shapes of the magnetic core particles enable both a thin-film portion and a thick-film portion to be present in the coating resin composition layer in the magnetic carrier coated with the coating resin composition, and the thin-film portion that is locally present serves as an electrode effect.

Further, the surface tension of the coating resin composition can be caused to act on each of the magnetic carrier particles by causing the filler effect of the carbon black to suitably act, and hence the coalescence of the particles of the magnetic carrier can be prevented in an additionally effective manner. The effect is affected by the primary particle diameter and agglomeration property of the carbon black. That is, the agglomeration property of the carbon black is high. Accordingly, the carbon black exists as an agglomerated particle and as a large particle, and hence the surface tension easily acts on the carbon black. Meanwhile, the carbon black is a particle having a small primary particle diameter and a large specific surface area, and hence a point of contact thereof with the resin composition enlarges. The surface tension of the coating resin composition easily acts on each magnetic carrier particle by virtue of the unique relationship between the primary particle diameter and the agglomeration property.

In addition, the inventors have found that the use of the agglomerated carbon black improves the developability. This is because of the following reason. The agglomerated carbon black has a large particle diameter, and hence the carbon black easily concentrates in the thick-film portion of the coating resin composition layer and the alleviation of counter charge is promoted in the thick-film portion of the coating resin composition layer where the counter charge alleviation has heretofore hardly worked.

In addition, the inventors of the present invention have made extensive studies, and have discovered a suitable balance between the filler effect of the carbon black and the particle diameter of the carbon black capable of satisfying the counter charge alleviation. That is, it is important that the particle diameter Pv showing the maximum frequency in the particle size distribution based on a volume of the carbon black in a toluene solution of the coating resin composition obtained by dispersing the magnetic carrier in toluene be 1.0 μm or more and 10.0 μm or less.

The inventors of the present invention have assumed that although the particle diameter Pv showing the maximum frequency obtained by the foregoing approach does not automatically represent the particle diameter of the carbon black in the coating resin composition layer, the particle diameter reflects the agglomerated state of the carbon black in the coating resin composition. Although the counter charge alleviation tends to be faster as the extent to which the carbon black agglomerates enlarges, it has also been confirmed that the counter charge alleviation tends to be faster as the particle diameter Pv showing the maximum frequency increases. In view of the foregoing, the inventors have assumed that the particle diameter Pv showing the maximum frequency reflects the agglomerated state of the carbon black in the coating resin composition.

The inventors of the present invention have produced samples largely different from each other in particle diameter Pv showing the maximum frequency, have identified the ratio at which the magnetic carrier having a crater-like shredded surface is mixed and the rate constant of the counter charge alleviation in each of the samples, and have determined the optimum range of the particle diameter Pv showing the maximum frequency based on the results.

Further, the inventors have discovered that the coalescence of the particles of the magnetic carrier can be prevented by controlling the amount of the coating resin composition.

That is, the amount of the coating resin composition is 2.0 parts by mass or more and 5.0 parts by mass or less with respect to 100.0 parts by mass of the filled core particles. Setting the amount within the range can maintain the irregular shapes of the porous magnetic core particles without impairing the shapes, and hence the surface tension of the coating resin composition can be caused to act on each of the magnetic carrier particles.

In addition, a method involving controlling the average pore diameter of the porous magnetic core particles is available as a method of controlling the irregular shapes of the porous magnetic core particles. The term "average pore diameter" refers to a value for a median pore diameter (on a volume basis) when pore diameters are specified to the range of 0.1 μm or more to 6.0 μm or less. The average pore diameter is preferably 0.7 μm to 1.4 μm, more preferably 0.9 μm to 1.3 μm. When the average pore diameter falls within the range, a surface of the porous magnetic core particle serves as a bridge even in a recessed portion to allow the surface tension of the coating resin composition to sufficiently work, and hence the surface tension can be caused to act on each of the magnetic carrier particles. Further, when the average pore diameter falls within the range, filling with the filling resin composition can be easily performed and hence even the insides of the porous magnetic core particles can be well-filled with the composition. Accordingly, the area of contact between the coating resin composition and each of the porous magnetic core particles can be enlarged. As a result, the surface tension of the coating resin composition easily acts and hence the coalescence of the particles of the magnetic carrier can be prevented.

On the other hand, when the magnetic core particles are bulky magnetic core particles or magnetic substance-dispersed core particles, no irregularities are present in the surfaces of the magnetic core particles, and hence the surface tension of the coating resin composition does not act on each of the magnetic carrier particles and the coalescence of the particles of the magnetic carrier occurs. Accordingly, a magnetic carrier having a crater is mixed into the final product by a sieving step, the external additive of the toner is selectively accumulated in the crater portion of the magnetic carrier at the time of long-term image output to impair the charge-providing performance of the magnetic carrier, and a fluctuation in color occurs in some cases. Further, the coating resin composition layer is formed only of a uniform thick-film portion. Accordingly, no thin-film portion exists and the electrode effect does not work, and hence the developability reduces and an image density reduces in some cases.

In addition, when the particle diameter Pv showing the maximum frequency in the particle size distribution based on a volume of the carbon black in the coating resin composition is less than 1.0 μm, the filler effect hardly acts, and hence the surface tension of the coating resin composition does not act on each of the magnetic carrier particles and the coalescence of the particles of the magnetic carrier occurs. Accordingly, a magnetic carrier having a crater is mixed into the final product by the sieving step, the external additive of the toner is selectively accumulated in the crater portion of the magnetic carrier at the time of the long-term image output to impair the charge-providing performance of the magnetic carrier, and the fluctuation in color occurs in some cases. Further, the agglomeration property of the carbon black is low, and hence the particle diameter of the carbon black does not increase even in the coating resin composition layer, and the carbon black is uniformly dispersed in the thin-film portion and thick-film portion of the coating resin composition layer. Accordingly, the counter charge alleviation does not favorably work in the thick-film portion of the coating resin composition layer, and hence the developability reduces and the image density reduces in some cases.

In addition, when the particle diameter Pv showing the maximum frequency in the particle size distribution based on a volume of the carbon black in the resin composition is more than 10.0 μm, the filler effect acts but the particle diameter of the carbon black increases. Accordingly, the carbon black serves as an interface to shred the magnetic carrier at the time of the coating. Accordingly, a magnetic carrier having a crater is also mixed into the final product, the external additive of the toner is selectively accumulated in the crater portion of the magnetic carrier at the time of the long-term image output to impair the charge-providing performance of the magnetic carrier, and the fluctuation in color occurs in some cases. Further, the agglomeration property of the carbon black is high, and hence the particle diameter of the carbon black in the coating resin composition is so large that a charge conduction path is formed between each of the porous magnetic core particles and the carbon black to cause the problem of leakage in some cases.

In addition, when the amount of the coating resin composition is less than 2.0 parts by mass with respect to 100.0 parts by mass of the filled core particles, the amount of the coating resin composition is small and hence a thin coating resin composition layer is formed. Accordingly, the particle diameter of the carbon black which has been controlled is so large as compared with the coating resin composition layer that a charge conduction path is formed between each of the porous magnetic core particles and the carbon black to cause the problem of the leakage in some cases. In addition, when the amount of the coating resin composition is more than 5.0 parts by mass with respect to 100.0 parts by mass of the filled core particles, the irregularities of the porous magnetic core particles are impaired at the time of the coating, and hence the surface tension does not act on each of the magnetic carrier particles and the coalescence of the particles of the magnetic carrier cannot be suppressed by the filler effect of the carbon black alone. Accordingly, a magnetic carrier having a crater is mixed into the final product by the sieving step at the time of the long-term image output, the external additive of the toner is selectively accumulated in the crater portion of the magnetic carrier at the time of the long-term image output to impair the charge-providing performance of the magnetic carrier, and the fluctuation in color occurs in some cases. Further, the irregularities of the porous magnetic core particles are coated. In addition, the coating resin composition layer is formed only of a uniform thick-film portion. Accordingly, no thin-film portion exists and the electrode effect does not work, and hence the developability reduces and the image density reduces in some cases.

(Method of Producing Porous Magnetic Core Particles)

The porous magnetic core particles of the present invention can be produced by such steps as described below.

A material for the porous magnetic core particles is preferably magnetite or ferrite. Further, the material for the porous magnetic core particle is more preferably ferrite because the porous structures of the porous magnetic core particles can be controlled and the resistance thereof can be adjusted.

The ferrite is a sintered body represented by the following general formula.

$(M1_2O)_x(M2O)_y(Fe_2O_3)_z$ (in the formula, M1 represents a monovalent metal, M2 represents a divalent metal, and when x+y+z is defined as 1.0, x and y each satisfy the relationship of $0 \leq (x,y) \leq 0.8$ and z satisfies the relationship of $0.2 < z < 1.0$.)

In the formula, one or more kinds of metal atoms selected from the group consisting of Li, Fe, Mn, Mg, Sr, Cu, Zn, and Ca are preferably used as M1 and M2.

In order to maintain an appropriate magnetization amount, thereby controlling pore diameters to a desired range, and to controlling the state of the irregularities in the surfaces of the porous magnetic core particles to a suitable one, an Mn-based ferrite, an Mn—Mg-based ferrite, an Mn—Mg—Sr-based ferrite, and an Li—Mn-based ferrite each containing an Mn element are more preferred from the viewpoints that the rate of the growth of a ferrite crystal can be easily controlled and the specific resistance and magnetic force of a porous magnetic core can be suitably controlled.

Production steps in the case of using the ferrite as the porous magnetic core particles are described in detail below.

Step 1 (Weighing/Mixing Step):

Raw Materials for the ferrite are weighed and mixed. Examples of the ferrite raw materials include the following: metal particles, oxides, hydroxides, carbonates, and oxalates of Li, Fe, Mn, Mg, Sr, Cu, Zn, and Ca. The pore volume is more likely to become large when hydroxides or carbonates are used as the kinds of raw materials to be blended than when oxides are used. For example, the following apparatus are each given as an apparatus for the mixing: a ball mill, a planetary mill, a Giotto mill, and a vibrating mill. In particular, a ball mill is preferred from the viewpoint of mixing property. Specifically, the weighed ferrite raw materials and balls are loaded into the ball mill, and the raw materials are pulverized and mixed for 0.1 hour or more and 20.0 hours or less.

Step 2 (Pre-Calcining Step):

The pulverized and mixed ferrite raw materials are pelletized with a pressure molding machine or the like, and then the raw materials are turned into ferrite by pre-calcining the pellet in the air at a calcination temperature in the range of 700° C. or more to 1,200° C. or less for 0.5 hour or more and 5.0 hours or less. For example, any one of the following furnaces is used in the calcination: a burner type calcining furnace, a rotary type calcining furnace, and an electric furnace.

Step 3 (Pulverizing Step):

The pre-calcined ferrite produced in the step 2 is pulverized with a pulverizer. The pulverizer is not particularly limited as long as a desired particle diameter is obtained. Examples thereof include the following: a crusher, a hammer mill, a ball mill, a bead mill, a planetary mill, and a Giotto mill. The control of the particle diameter distribution of the finely pulverized product of the pre-calcined ferrite is important because this control leads to the control of the pore diameter distribution of the porous magnetic core particles and finally leads to the control of the degree of irregularity of the surface of the magnetic carrier. In order that the particle diameter distribution of the finely pulverized product of the pre-calcined ferrite may be controlled, in, for example, the ball mill or the bead mill, a material for balls or beads to be used and an operating time are preferably controlled. Specifically, the use of a ball having a large specific gravity or the lengthening of a pulverization time suffices for the reduction of the particle diameter of the pre-calcined ferrite. In addition, the particle size distribution of the pre-calcined ferrite can be widened by using a ball having a large specific gravity and shortening the pulverization time. A pre-calcined ferrite having a wide distribution can be obtained by mixing multiple pre-calcined ferrites having different particle diameters as well. The material for the balls or the beads is not particularly limited as long as a desired particle diameter and a desired distribution are obtained. Examples thereof include the following: glasses such as soda glass (having a specific gravity of 2.5 g/cm$^3$), sodaless glass (having a specific gravity of 2.6 g/cm$^3$), and high-specific gravity glass (having a specific gravity of 2.7 g/cm$^3$), quartz (having a specific gravity of 2.2 g/cm$^3$), titania (having a specific gravity of 3.9 g/cm$^3$), silicon nitride (having a specific gravity of 3.2 g/cm$^3$), alumina (having a specific gravity of 3.6 g/cm$^3$), zirconia (having a specific gravity of 6.0 g/cm$^3$), steel (having a specific gravity of 7.9 g/cm$^3$), and stainless steel (having a specific gravity of 8.0 g/cm$^3$). Of those, alumina, zirconia, and stainless steel are preferred because of excellent wear resistance. The particle diameters of the balls or the beads are not particularly limited as long as a desired particle diameter and a desired distribution are obtained. For example, balls each having a diameter of 5 mm or more and 60 mm or less are suitably used as the balls. In addition, beads each having a diameter of 0.03 mm or more and 5 mm or less are suitably used as the beads. In addition, a wet ball mill or a wet bead mill has higher pulverization efficiency than that of a dry one because a pulverized product does not fly in the mill. Accordingly, the wet one is more preferred to the dry one.

Step 4 (Granulating Step):

A dispersant, water, and a binder, and as required, a pore regulator may be added to the finely pulverized product of the pre-calcined ferrite. Examples of the pore regulator include a foaming agent and resin fine particles. For example, polyvinyl alcohol is used as the binder. When the pre-calcined ferrite is pulverized with a wet mill in the step 3, the binder, and as required, the pore regulator are preferably added in consideration of water in a ferrite slurry.

The resultant ferrite slurry is dried and granulated with a spray drying machine under a warming atmosphere having a temperature of 100° C. or more and 200° C. or less. The spray drying machine is not particularly limited as long as a desired particle diameter is obtained. For example, a spray drier can be used.

Step 5 (Calcining Step):

Next, the dispersant and the binder are removed from the granulated product by combustion at a temperature of 600° C. or more and 800° C. or less. After that, the resultant is calcined in an electric furnace whose oxygen concentration can be controlled under an atmosphere whose oxygen concentration has been controlled at a temperature of 800° C. or more and 1,300° C. or less for 1 hour or more and hours or less. The temperature is more preferably 1,000° C. or more and 1,200° C. or less. The rate of crystal growth can be controlled by shortening a temperature increase time or lengthening a temperature decrease time, and hence a desired porous structure can be obtained. The time period for which the calcination temperature is held is preferably 3 hours or more and 5 hours or less in order that the desired porous structure may be obtained. The calcination of a porous magnetic core is advanced by increasing the calcination temperature or lengthening a calcination time. In this case, a rotary type electric furnace, a batch type electric furnace, a continuous electric furnace, or the like is used, and the oxygen concentration of the atmosphere at the time of the calcination may be controlled by blowing an inert gas such as nitrogen, or a reducing gas such as hydrogen or carbon monoxide into the atmosphere. Alternatively, the oxygen concentration may be controlled as described below. The binder added at the time of the granulation is decomposed in the furnace by performing the calcination without performing the removal of the binder, and then a reducing atmosphere is established in the furnace with the generated gas. In addition, in the case of the rotary type electric furnace, the calcination may be performed multiple times by changing the atmosphere and the calcination temperature.

Step 6 (Sorting Step):

After the calcined particles have been shredded, as required, a low-magnetic force product may be separated by magnetic separation, and coarse particles and fine particles may be removed by classification or sieving with a sieve.

Step 7 (Surface Treatment):

Resistance adjustment can be performed as required by heating the surfaces of the resultant particles at low temperature to subject the surfaces to an oxide film treatment. A heat treatment with a general rotary type electric furnace, batch type electric furnace, or the like at, for example, 300° C. or more and 700° C. or less can be performed as the oxide film treatment.

The 50% particle diameter (D50) based on a volume of the porous magnetic core particles obtained as described above is preferably 18.0 μm or more and 68.0 μm or less in order that the particle diameter of the final magnetic carrier may be set to 20.0 μm or more and 70.0 μm or less. Thus, triboelectric charge-providing performance for the toner can be improved, the image quality of a halftone portion can be satisfied, and the suppression of fogging and the prevention of carrier adhesion can be achieved.

The specific resistance of the porous magnetic core particles in an electric field intensity of 300 V/cm in a specific resistance-measuring method to be described later is preferably $5.0\times10^6$ Ω·cm or more and $5.0\times10^8$ Ω·cm or less because the developability can be improved.

The total pore volume of the porous magnetic core particles is preferably 35 $mm^3/g$ or more and 95 $mm^3/g$ or less because the particles have irregular shapes suitable upon coating with the coating resin composition. Further, such total pore volume is preferred because the magnetic carrier can obtain strength enough to resist a stress due to, for example, stirring in a developing unit.

(Method of Producing Filled Core Particles)

Adoptable as a method of filling the pores of the porous magnetic core particles with the filling resin composition is a method involving: dissolving a filling resin with a solvent; adding the resultant to the pores of the porous magnetic core particles; and removing the solvent. The solvent to be used here has only to be capable of dissolving the filling resin. Examples of such organic solvent include toluene, xylene, cellosolve butyl acetate, methyl ethyl ketone, methyl isobutyl ketone, and methanol. Available as a method of filling the pores of the porous magnetic core particles with the resin is, for example, a method involving: impregnating the porous magnetic core particles with a resin solution by an application method such as an immersion method, a spray method, a brush coating method, or a fluidized bed; and then volatilizing the solvent.

The immersion method is preferably a method involving: filling the pores of the porous magnetic core particles with a filling resin composition solution, which is obtained by mixing the filling resin and the solvent, in a decompressed state; and removing the solvent by deaeration or warming. The impregnation property of the filling resin composition into the pores of the porous magnetic core particles can be controlled by controlling, through the rate of the deaeration or the temperature of the warming, the speed at which the solvent is removed. The degree of the decompression is preferably about $1.30\times10^3$ Pa to $9.30\times10^4$ Pa.

Although the pores can be filled with the filling resin composition in one filling step, the pores are preferably filled with the composition in multiple steps. This is because when one attempts to fill the pores with a large amount of the filling resin composition all at once, the coalescence of the particles of the magnetic carrier may occur depending on the kind of the filing resin composition. In such case, when the pores are filled with the composition in multiple steps, the pores can each be filled with a proper amount of the composition while the coalescence of the particles of the magnetic carrier is prevented.

After the pores have been filled with the filling resin composition, heating is performed by various systems as required to cause the filling resin composition with which the pores have been filled to closely adhere to the porous magnetic core particles. Any one of an external heating system and an internal heating system is available as the heating system. For example, a fixed or fluid type electric furnace, a rotary type electric furnace, or a burner furnace is permitted, and baking with a microwave is also permitted. Although a temperature for the heating varies depending on the filling resin composition with which the pores are filled, increasing the temperature to such a temperature that the curing of the composition sufficiently proceeds can provide a magnetic carrier having highly resistant to an impact. The particles are preferably treated in a stream of an inert gas such as nitrogen in order that their oxidation may be prevented.

The amount of the filling resin composition with which the pores are filled is preferably 60 vol % to 90 vol % with respect to the pore volume of the porous magnetic core particles. The amount is more preferably 70 vol % to 80 vol % from the viewpoint of improving the coatability of the filling resin composition.

That is, the amount of the filling resin composition with which the pores are filled has only to be the occupied volume described above according to the pore volume of the porous magnetic core particles. In particular, from the viewpoint of the strength of the magnetic core particles, the total pore volume of the porous magnetic core particles is preferably 35 $mm^3/g$ or more and 95 $mm^3/g$ or less, and the amount of the filling resin composition with which the pores are filled is preferably 3.0 to 10.0 parts by mass with respect to 100 parts by mass of the porous magnetic core particles. The amount is more preferably 6.0 to 8.0 parts by mass because of the following reason. The irregular shapes of the filled core particles are maintained and hence the surface tension of the coating resin composition acts.

The amount of the resin solid content in the filling resin composition solution is preferably 6 mass % or more and 25 mass % or less from the viewpoints of the property by which the pores are filled with the composition and a time period required for the removal of the solvent because the viscosity of the filling resin composition solution can be easily handled.

The filling resin in the filling resin composition with which the pores of the porous magnetic core particles are filled, which is not particularly limited, is preferably a resin having high impregnation property. The resin having high impregnation property is preferably used from the viewpoint of the surface tension of the coating resin composition as described above because of the following reason. Pores inside the porous magnetic core particles are filled with the composition first and hence pores near the surfaces of the filled core particles remain, and as a result, the surfaces of the filled core particles have shapes with irregularities based on the pores.

The filling resin in the filling resin composition may be any of a thermoplastic resin and a thermosetting resin. A thermosetting resin which is not dissolved even when a solvent is used at the time of coating is preferred for coating a magnetic carrier. A silicone resin is more preferred because of the ease of filling with the resin. For example, commercially available products thereof include the following: straight silicone resins such as KR-271, KR-251, and KR-255 manufactured by Shin-Etsu Chemical Co., Ltd., and SR2400, SR2405, SR2410, and SR2411 manufactured by Dow Corning Toray Co., Ltd.; and modified silicone resins such as KR206 (alkyd modified), KR5208 (acrylic modified), ES1001N (epoxy modified), and SR2110 (alkyd modified) manufactured by Shin-Etsu Chemical Co., Ltd.

In addition, the filling resin composition preferably contains a silane coupling agent. The composition preferably contains the silane coupling agent from the viewpoint of the surface tension of the coating resin composition as described above because of the following reason. The silane coupling agent has good compatibility with the filling resin, and hence wettability and adhesiveness between the porous magnetic core particles and the filling resin additionally improve. Accordingly, the pores inside the porous magnetic core particles are filled with the filling resin first. As a result, the surfaces of the filled core particles have shapes with irregularities based on the pores.

The silane coupling agent to be used, which is not particularly limited, is preferably an aminosilane coupling agent because an affinity for the coating resin composition also becomes good by virtue of the presence of a functional group.

It should be noted that the reason why the aminosilane coupling agent additionally improves the wettability and adhesiveness between the porous magnetic core particles and the filling resin, and makes the affinity for the coating resin composition good is considered to be as described below. The aminosilane coupling agent has a portion to react with inorganic matter and a portion to react with organic matter. In general, an alkoxy group is considered to react with the inorganic matter and a functional group having an amino group is considered to react with the organic matter. Accordingly, it is assumed that the alkoxy group of the aminosilane coupling agent reacts with a portion of the porous magnetic core particles to improve the wettability and the adhesiveness, and the functional group having the amino group orients toward the filling resin to improve the affinity for the coating resin composition.

The amount of the silane coupling agent to be added is preferably 1.0 to 20.0 parts by mass with respect to 100 parts by mass of the amount of the filling resin. The amount is more preferably 5.0 to 10.0 parts by mass from the viewpoint of improving the wettability and adhesiveness between the porous magnetic core particles and the filling resin.

The 50% particle diameter (D50) based on a volume of the filled core particles is preferably 19.0 μm or more and 69.0 μm or less in order that the particle diameter of the final magnetic carrier may be set to 20.0 μm or more and 70.0 μm or less. Thus, the carrier adhesion can be suppressed.

The specific resistance of the filled core particles in an electric field intensity of 1,000 V/cm in the specific resistance-measuring method to be described later is preferably $1.0\times10^7$ Ω·cm or more and $1.0\times10^9$ Ω·cm or less because the developability can be improved. In a developing section, the magnetic carrier is exposed to higher electric field intensity together with the toner, but the toner is an insulator and hence the electric field intensity is dominantly applied to the toner. Accordingly, the electric field intensity applied to the magnetic carrier becomes lower. Specifically, the electric field intensity is about 1,000 V/cm. Accordingly, the inventors of the present invention have adopted a specific resistance in an electric field intensity of 1,000 V/cm in the specific resistance-measuring method.

(Method of Producing Magnetic Carrier)

A method of coating the surfaces of the filled core particles with the coating resin composition is preferably a kneader coater method from the viewpoint of preventing the coalescence of the particles of the magnetic carrier and the viewpoint of controlling the agglomeration property of the carbon black.

A magnetic carrier coated with the coating resin composition in which the agglomeration property of the carbon black has been controlled can be obtained by the kneader coater method involving: loading the filled core particles and the coating resin composition solution into a vacuum deaeration type kneader; stirring the mixture under heat; and reducing a pressure in the kneader after the stirring to remove the solvent.

The same method as that in the filling step is employed for the preparation of the coating resin composition solution. A method of suppressing the coalescence at the time of a coating step is, for example, the adjustment of: a resin concentration in the resin solution with which the surfaces are coated; a temperature in an apparatus for the coating; a temperature and degree of decompression at the time of the removal of the solvent; the number of revolutions of the kneader; and the number of times of resin coating steps. In particular, it is preferred to increase the temperature in association with the viscosity of the resin composition rather than to volatilize the solvent in one stroke in order that the coalescence of the particles of the magnetic carrier may be prevented. First, the filled core particles and the coating resin composition are loaded into the vacuum deaeration type kneader, and the solvent is volatilized at "normal temperature." Then, once a certain amount (80 mass %) or more of the solvent is volatilized, and hence the viscosity of the mixture increases and load power on the apparatus increases, the solvent is further volatilized by increasing the temperature to 80° C.

A coating resin in the coating resin composition to be used in the coating resin composition layer is not particularly limited. Examples thereof include a polyvinyl-based resin, a styrene-acrylic acid copolymer, a straight silicone resin formed of an organosiloxane bond or a denatured product thereof, and a fluororesin. Of those, the polyvinyl-based resin is preferred from the viewpoint of the stability of charge provision in long-term image output.

In addition, the coating resin in the coating resin composition preferably has a cyclic hydrocarbon group in its molecular structure. Coating with the coating resin composition having the cyclic hydrocarbon group can suppress the occurrence of solid carrier adhesion due to a reduction in resistance of the magnetic carrier caused by the moisture adsorption of the magnetic carrier under a high-temperature, high-humidity environment.

It should be noted that a suppressing effect of the coating with the coating resin composition on the moisture adsorption of the magnetic carrier under the high-temperature, high-humidity environment is considered to be as described below. When the surfaces of the filled core particles are coated with the coating resin composition, such a coating step as to involve mixing a solution prepared by dissolving the coating resin composition in an organic solvent and the filled core particles, and removing the solvent from the mixture is performed. In the step, the solvent is removed while the cyclic hydrocarbon group orients toward the surface of the coating resin composition layer. As a result, the coating resin composition layer is formed on the surface of the completed magnetic carrier in a state where the cyclic hydrocarbon group that is highly hydrophobic orients toward the surface, and hence the moisture adsorption is suppressed.

Specific examples of the cyclic hydrocarbon group include cyclic hydrocarbon groups each having 3 or more and or less carbon atoms such as a cyclohexyl group, a cyclopentyl group, an adamantyl group, a cyclopropyl group, a cyclobutyl group, a cycloheptyl group, a cyclooctyl group, a cyclononyl group, a cyclodecyl group, an isobornyl group, a norbornyl group, and a boronyl group. Of those, a cyclohexyl group, a cyclopentyl group, and an adamantyl group are preferred, and a cyclohexyl group is particularly preferred from the viewpoint that the group is structurally stable, thereby having high adhesiveness for the filled core particles.

In addition, in order to adjust a glass transition temperature (Tg), any other monomer may be further incorporated as a constituent component of the vinyl-based resin.

A known monomer is used as the other monomer to be used as a constituent component of the coating resin composition, and examples thereof include the following: styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether, and vinyl methyl ketone.

Further, the coating resin composition to be used in the coating resin composition layer is preferably a graft polymer because its wettability with the porous magnetic core particles becomes additionally good and hence the surface tension of the coating resin composition easily acts.

A method involving forming a stem chain and subjecting the resultant to graft polymerization or a method involving performing copolymerization with a macromonomer as a monomer is available for obtaining the graft polymer. Of those, the method involving using a copolymerized product of the macromonomer is preferred because the molecular weight of a branch chain can be easily controlled.

The macromonomer to be used, which is not particularly limited, is preferably a methyl methacrylate macromonomer because the wettability with the porous magnetic core particles becomes additionally good.

It should be noted that the reason why the wettability with the porous magnetic core particles becomes good by virtue of the fact that the coating resin composition has the methyl methacrylate macromonomer derives from the fact that while the cyclic hydrocarbon group orients toward the surface of the coating resin composition layer, the macromonomer having largely different hydrophobicity orients toward the filled core particles. In addition, the macromonomer works on the wettability with the porous magnetic core particles probably because the macromonomer has an oligomer molecule having a reactive functional group at a terminal of the polymer.

The amount of the macromonomer to be used at the time of the polymerization is preferably 10 to 50 parts by mass, more preferably 20 to 40 parts by mass with respect to 100 parts by mass of a copolymer as the stem chain of the vinyl-based resin.

In addition, the carbon black in the coating resin composition, which is not particularly limited, preferably has a primary particle diameter of 50 nm or less, a nitrogen adsorption specific surface area of 150 $m^2/g$, and a dibutyl phthalate (DBP) oil absorption of 50 ml/100 g or more and 300 ml/100 g or less from the viewpoints of the specific surface area and agglomeration property of the carbon black.

Further, the adjustment of the number of revolutions of the vacuum deaeration type kneader and the dispersed state of the carbon black in the coating resin composition is important in order that the particle diameter Pv showing the maximum frequency in the particle size distribution based on a volume of the carbon black in the toluene solution of the coating resin composition obtained by dispersing the magnetic carrier in toluene may be set to 1.0 μm or more and 10.0 μm or less.

With regard to the number of revolutions of the vacuum deaeration type kneader, as described above, the viscosity of the resin composition increases as the solvent is slowly volatilized. At this time, desired agglomeration of the carbon black is obtained by strongly kneading the composition at the number of revolutions of the kneader as small as 40 rpm or less.

In addition, the dispersed state of the carbon black in the coating resin composition is preferably adjusted with a disperser using media such as beads. Examples of the disperser include a sand mill, a grain mill, a basket mill, a ball mill, a Sand Grinder, a Visco Mill, a paint shaker, an attritor, a Dyno-Mill, and a Pearl Mill. Of those, a paint shaker is preferred because a suitable agglomerated state of the carbon black is obtained. In order that a suitable agglomerated state of the carbon black may be obtained, it is important that the carbon black be not excessively dispersed, and it is preferred that the particle diameters of beads be large, a soft material be selected for the beads, and the dispersion be performed in a short time period. A conventional method has involved dispersing the carbon black with a homogenizer. However, the method has been unable to provide the agglomerated state of the carbon black like the present invention.

The content of the carbon black is preferably 10.0 parts by mass or more and 30.0 parts by mass or less with respect to 100.0 parts by mass of the coating resin in the coating resin composition in order that the agglomeration property of the carbon black may be controlled. Further, such content is preferred in order that an image defect such as leakage may not be caused.

In addition, particles or materials having electric conductivity other than the carbon black, or particles or materials having charge control property may be incorporated into the coating resin composition before use. Examples of the particles having charge control property include particles of an organic metal complex, particles of an organic metal salt, particles of a chelate compound, particles of a monoazo metal complex, particles of an acetylacetone metal complex, particles of a hydroxycarboxylic acid metal complex, particles of a polycarboxylic acid metal complex, particles of a polyol metal complex, particles of a polymethyl methacrylate resin, particles of a polystyrene resin, particles of a melamine resin, particles of a phenol resin, particles of a nylon resin, particles of silica, particles of titanium oxide, and particles of alumina. The addition amount of the particles having charge control property is preferably 0.5 part by mass or more and 50.0 parts by mass or less with respect to 100 parts by mass of the coating resin, for adjusting a triboelectric charge quantity.

The magnetic carrier of the present invention preferably has a 50% particle diameter (D50) based on a volume of 20.0 μm or more and 70.0 μm or less because the carrier adhesion can be suppressed, spent toner can be suppressed, and the carrier can be stably used even when used for a long time period.

The specific resistance of the magnetic carrier of the present invention in an electric field intensity of 1,000 V/cm in the specific resistance-measuring method to be described later is preferably $5.0\times10^{7}$ Ω·cm or more and $5.0\times10^{9}$ Ω·cm or less because the developability can be improved while the leakage is suppressed.

(Method of Producing Toner)

Next, the toner to be incorporated into a two-component developer or developer for replenishment together with the magnetic carrier is described. The toner has: toner particles each containing a binding resin, a coloring agent, and a wax; and inorganic fine powders.

For example, the following methods are each available as a method of producing the toner particles of the toner in the present invention: a pulverization method involving melting and kneading the binding resin, the coloring agent, and the wax, cooling the kneaded product, and pulverizing and classifying the cooled product; a suspension granulation method involving dissolving or dispersing the binding resin and the coloring agent in a solvent to prepare a solution, introducing the solution into an aqueous medium, subjecting the mixture to suspension granulation, and removing the solvent to provide the toner particles; a suspension polymerization method involving uniformly dissolving or dispersing the coloring agent and the like in a monomer to prepare a monomer composition, dispersing the monomer composition in a continuous layer (such as an aqueous phase) containing a dispersion stabilizer, and subjecting the resultant to a polymerization reaction to produce the toner particles; a dispersion polymerization method involving dissolving a polymer dispersant in an aqueous organic solvent and polymerizing the monomer to produce particles that are insoluble in the solvent, thereby providing the toner particles; an emulsion polymerization method involving directly polymerizing the monomer in the presence of a water-soluble polar polymerization initiator to produce the toner particles; and an emulsion agglomeration method involving at least a step of agglomerating polymer fine particles and coloring agent fine particles to form a fine particle agglomerate and an aging step of causing melt adhesion between fine particles in the fine particle agglomerate to provide the toner particles. Particularly in the case of the toner obtained by the pulverization method, the amount of small particles can be reduced by modifying the surface of the toner through a mechanical or thermal treatment after the pulverization or after the pulverization and the classification.

Examples of the binding resin to be incorporated into the toner include the following: a polyester and a polystyrene; polymers of styrene derivatives such as a poly-p-chlorostyrene and a polyvinyltoluene; styrene copolymers such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, and a styrene-acrylonitrile-indene copolymer; a polyvinyl chloride, a phenol resin, a modified phenol resin, a maleic resin, an acrylic resin, a methacrylic resin, a polyvinyl acetate, and a silicone resin; a polyester resin having, as a structural unit, a monomer selected from an aliphatic polyhydric alcohol, an aliphatic dicarboxylic acid, an aromatic dicarboxylic acid, an aromatic dialcohol, and a diphenol; and a polyurethane resin, a polyamide resin, a polyvinyl butyral, a terpene resin, a coumarone-indene resin, a petroleum resin, and a hybrid resin having a polyester unit and a vinyl-based polymer unit.

In order to achieve compatibility between the storage stability and low-temperature fixability of the toner, the binding resin to be used in the present invention preferably has a peak molecular weight (Mp) in a molecular weight distribution measured by gel permeation chromatography (GPC) of 2,000 or more and 50,000 or less, a number-average molecular weight (Mn) of 1,500 or more and 30,000 or less, a weight-average molecular weight (Mw) of 2,000 or more and 1,000,000 or less, and a glass transition temperature (Tg) of 40° C. or more and 80° C. or less.

The wax is preferably used in an amount of 0.5 part by mass or more and 20.0 parts by mass or less per 100 parts by mass of the binding resin because an image having a high gloss value can be provided. In addition, the peak temperature of the highest endothermic peak of the wax is preferably 45° C. or more and 140° C. or less. Such temperature is preferred because compatibility between the storage stability and hot offset resistance of the toner can be achieved.

Examples of the wax include the following: hydrocarbon-based waxes such as a low-molecular-weight polyethylene, a low-molecular-weight polypropylene, an alkylene copolymer, a microcrystalline wax, a paraffin wax, and a Fischer-Tropsch wax; oxides of hydrocarbon-based waxes such as an oxidized polyethylene wax, or block copolymerization products thereof; waxes using fatty acid esters as main components such as a carnauba wax, a behenic acid behenyl ester wax, and a montanic acid ester wax; and waxes obtained by partially or wholly deacidifying fatty acid esters such as a deacidified carnauba wax. Of those, hydrocarbon-based waxes such as a Fischer-Tropsch wax are preferred because an image having a high gloss value can be provided.

Examples of the coloring agent to be incorporated into the toner include the following.

As black coloring agents, there are given: carbon black; a magnetic substance; and a black-toned product obtained by using a yellow coloring agent, a magenta coloring agent, and a cyan coloring agent. As magenta coloring agents, there are given a condensed azo compound, a diketopyrrolopyrrole compound, anthraquinone, a quinacridone compound, a basic dye lake compound, a naphthol compound, a benzimidazolone compound, a thioindigo compound, and a perylene compound. As cyan coloring agents, there are given: C.I. Pigment Blue 1, 2, 3, 7, 15:2, 15:3, 15:4, 16, 17, 60, 62, and 66; C.I. Vat Blue 6, C.I. Acid Blue 45, and a copper phthalocyanine pigment having a phthalocyanine skeleton substituted with one to five phthalimidemethyl. As yellow coloring agents, there are given a condensed azo compound, an isoindolinone compound, an anthraquinone compound, an azo metal compound, a methine compound, and an allylamide compound. A pigment may be used alone as the coloring agent, but it is more preferred to use a dye and a pigment in combination to improve the color definition from the viewpoint of the image quality of a full-color image.

The usage of the coloring agent is preferably 0.1 part by mass or more and 30.0 parts by mass or less, more preferably 0.5 part by mass or more and 20.0 parts by mass or less with respect to 100 parts by mass of the binding resin except for the case where the magnetic substance is used.

A charge control agent can be incorporated into the toner as required. Although any one of the known agents can be utilized as the charge control agent to be incorporated into the toner, a metal compound of an aromatic carboxylic acid that is colorless, charges the toner at a high speed, and can stably hold a certain charge quantity is particularly preferred. The charge control agent may be internally added to the toner particles, or may be externally added thereto. The addition amount of the charge control agent is preferably 0.2 part by mass or more and 10 parts by mass or less with respect to 100 parts by mass of the binding resin.

The inorganic fine powder is added as an external additive to the toner for improving its flowability. Silica, titanium oxide, and aluminum oxide can be given as examples of the inorganic fine powder. The inorganic fine powder is preferably hydrophobized with a hydrophobizing agent such as a silane compound, a silicone oil, or a mixture thereof. The external additive is preferably used in an amount of 0.1 part by mass or more and 5.0 parts by mass or less with respect to 100 parts by mass of the toner particles. A known mixer such as a Henschel mixer can be used for mixing the toner particles and the external additive.

A process of producing the toner by the pulverization method is described.

In a raw material mixing step, as materials for constituting the toner particles, for example, the binding resin, the coloring agent, and the wax, and as required, any other component such as the charge control agent are weighed in predetermined amounts, and then blended and mixed. An apparatus for the mixing is, for example, a double cone mixer, a V type mixer, a drum type mixer, a Super mixer, a Henschel mixer, a Nauta Mixer, or a Mechano Hybrid (manufactured by NIPPON COKE & ENGINEERING CO., LTD.).

Next, the mixed materials are melted and kneaded so that the coloring agent and the like may be dispersed in the binding resin. In the melting and kneading step, a batch type kneading machine such as a pressure kneader or a Banbury mixer, or a continuous kneading machine can be used, and a single or twin screw extruder is mainly used because of having an advantage in that continuous production can be performed. Examples thereof include a KTK type twin screw extruder (manufactured by KOBE STEEL, LTD.), a TEM type twin screw extruder (manufactured by Toshiba Machine Co., Ltd.), a PCM kneader (manufactured by Ikegai Corp.), a twin screw extruder (manufactured by KCK), a co-kneader (manufactured by BUSS), and a Kneadex (manufactured by NIPPON COKE & ENGINEERING CO., LTD.).

Further, a colored resin composition to be obtained by the melting and kneading is rolled with a two-roll or the like, and may be cooled with water or the like in a cooling step.

Next, in a pulverizing step, the cooled resin composition is pulverized so as to have a desired particle diameter. In the pulverizing step, for example, the cooled resin composition is coarsely pulverized with a pulverizer such as a crusher, a hammer mill, or a feather mill, and is then further finely pulverized with, for example, a Kryptron System (manufactured by Kawasaki Heavy Industries, Ltd.), a Super Rotor (manufactured by Nisshin Engineering Inc.), a Turbo Mill (manufactured by FREUND-TURBO CORPORATION), or a fine pulverizer of an air-jet mode.

After that, as required, the pulverized product is classified with a classifier or a screen classifier, such as an Elbow Jet (manufactured by Nittetsu Mining Co., Ltd.) of an inertial classification mode, a Turboplex (manufactured by Hosokawa Micron Corporation) of a centrifugal force classification mode, a TSP Separator (manufactured by Hosokawa Micron Corporation), or a Faculty (manufactured by Hosokawa Micron Corporation). Thus, toner particles are obtained.

Further, as required, the pulverized product may be subjected to a surface modification treatment for toner particles such as a spheroidization treatment using a Hybridization System (manufactured by Nara Machinery Co., Ltd.), a Mechanofusion System (manufactured by Hosokawa Micron Corporation), a Faculty (manufactured by Hosokawa Micron Corporation), or a Meteorainbow MR Type (manufactured by Nippon Pneumatic Mfg. Co., Ltd.).

With regard to a mixing ratio between the toner and magnetic carrier of the two-component developer, the toner is used in an amount of preferably 2.0 parts by mass or more and 15.0 parts by mass or less, more preferably 4.0 parts by mass or more and 12.0 parts by mass or less with respect to 100.0 parts by mass of the magnetic carrier. Setting the mixing ratio within the range reduces the flying of the toner and stabilizes the triboelectric charge quantity of the developer over a long time period.

With regard to a mixing ratio between the toner and magnetic carrier of the developer for replenishment, the toner is used in an amount of preferably 2.0 parts by mass or more and 50.0 parts by mass or less, more preferably 4.0 parts by mass or more and 20.0 parts by mass or less with respect to 1.0 part by mass of the magnetic carrier. Setting the blending ratio within the range can reduce the frequency at which the developer for replenishment is replaced, the replacement serving as a load on a user, while securing a stable triboelectric charge quantity of the developer.

In the case of preparing the developer for replenishment, the magnetic carrier and toner were weighed in desired amounts and mixed with a mixer. Examples of the mixer include a double cone mixer, a V type mixer, a drum type mixer, a Super mixer, a Henschel mixer, and a Nauta mixer. Of those, a V type mixer is preferably used from the viewpoint of the dispersibility of the magnetic carrier.

The measurement of various physical properties according to the present invention is described below.

<Method of Measuring 50% Particle Diameter (D50) Based on Volume of Each of Magnetic Carrier, Filled Core Particles, and Porous Magnetic Core Particles>

Particle size distribution measurement was performed with a particle size distribution-measuring apparatus "Microtrac MT3300EX" (manufactured by NIKKISO CO., LTD.) of a laser diffraction/scattering system.

At the time of the measurement of the 50% particle diameter (D50) based on a volume of each of the magnetic carrier and the porous magnetic core particles, the apparatus was mounted with a sample-supplying machine "one-shot dry type sample conditioner Turbotrac" (manufactured by NIKKISO CO., LTD.) for dry measurement. Conditions under which the Turbotrac supplies a sample are as described below. A dust collector was used as a vacuum source, and the airflow rate and the pressure were set to about 33 l/sec and about 17 kPa, respectively. The control of the machine is automatically performed on software. A 50% particle diameter (D50) as an accumulated value based on a volume is determined as a particle diameter. The control and the analysis are performed with the software included with the machine (version 10.3.3-202D). Conditions for the measurement are as described below.

Set Zero time: 10 seconds
Measurement time: 10 seconds
Number of Measurement: 1
Particle refractive index: 1.81
Particle shape: nonspherical
Measurement upper limit: 1,408 μm
Measurement lower limit: 0.243 μm
Measurement environment: about 23° C./50% RH <Measurement of Specific Resistance of Magnetic Carrier in Electric Field Intensity of 1,000 V/cm, Specific Resistance of Filled Core Particles in Electric Field Intensity of 1,000 V/Cm, and Specific Resistance of Porous Magnetic Core Particles in Electric Field Intensity of 300 V/cm>

Figure 1B:
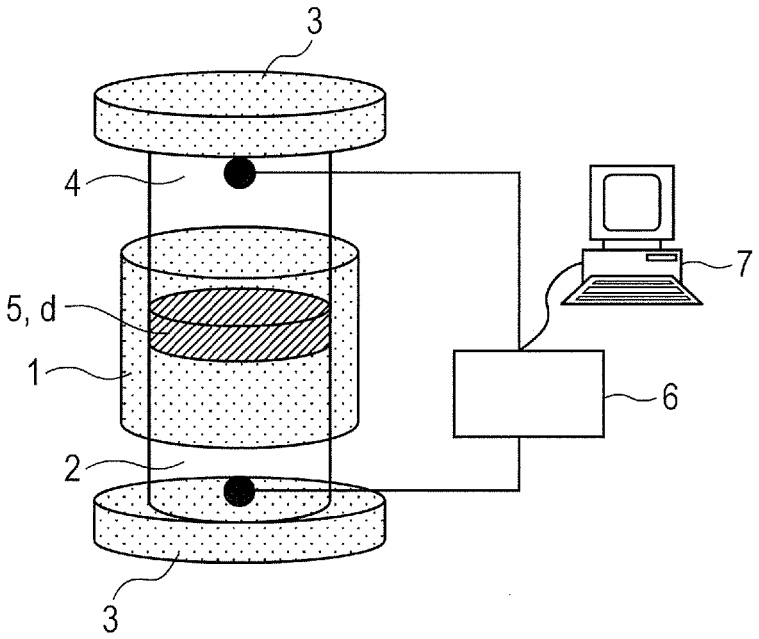
FIG. 1B is a schematic view of the apparatus for measuring the specific resistances of porous magnetic core particles, filled core particles, and a magnetic carrier used in the present invention.

The specific resistance of the magnetic carrier in an electric field intensity of 1,000 V/cm, the specific resistance of the filled core particles in an electric field intensity of 1,000 V/cm, and the specific resistance of the porous magnetic core particles in an electric field intensity of 300 V/cm are measured with a measuring apparatus schematically illustrated in FIGS. 1A and 1B.

A resistance-measuring cell A is constituted of: a cylindrical PTFE resin container 1 perforated with a hole having a sectional area of 4.906 $cm^2$; a lower electrode (made of stainless steel) 2 having an electrode area of 4.906 $cm^2$; insulating members 3; and an upper electrode (made of stainless steel) 4 having an electrode area of 4.906 $cm^2$. The lower electrode (made of stainless steel)$_2$ is mounted on the insulating member 3 and then the lower electrode (made of stainless steel) 2 is passed through the hole of the cylindrical PTFE resin container 1. Next, the upper electrode (made of stainless steel) 4 is mounted on the lower electrode (made of stainless steel)$_2$. The insulating member 3 is mounted thereon. Then, a load of 100 N is applied to the upper insulating member 3 with a manual stand SVH-1000N (manufactured by IMADA). The load at that time is measured with a digital force gauge DS2-200N (manufactured by IMADA). Then, zero point adjustment is performed with vernier calipers (manufactured by Mitutoyo) provided to the SVH-1000N (FIG. 1A).

Next, a gap between the lower electrode (made of stainless steel) 2 and the upper electrode (made of stainless steel) 4 is filled with a sample (the magnetic carrier, the filled core particles, or the porous magnetic core particles) 5 so that its thickness may be about 1 mm, followed by the application of a load of 100 N as in the foregoing. Then, an increase in height is measured with the vernier calipers and defined as the thickness of the sample (FIG. 1B).

At this time, it is important that the mass of the sample be appropriately changed so that the thickness of the sample may be 0.95 mm or more and 1.04 mm or less.

The specific resistance of each of the magnetic carrier and the porous magnetic core particles can be determined by applying a DC voltage between the electrodes and measuring a current that flows at this time. An electrometer 6 (Keithley 6517A manufactured by Keithley Instruments Inc.) and a computer 7 for control are used in the measurement.

A control system manufactured by National Instruments Corporation and a control software (LabVIEW manufactured by National Instruments Corporation) are used in the computer for control. Input as conditions for the measurement are an area S of contact between the sample and each electrode of 4.906 $cm^2$, and a value d actually measured so that the thickness of the sample may be 0.95 mm or more and 1.04 mm or less. In addition, the load and the maximum applied voltage are set to 100 N and 1,000 V, respectively.

Conditions for the application of the voltage are as described below. An IEEE-488 interface is used for control between the computer for control and the electrometer, and such screening that voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V), and 1,000 V are each applied for 1 second is performed by utilizing the automatic range function of the electrometer. At that time, the electrometer judges whether a maximum voltage of up to 1,000 V (10,000 V/cm in terms of an electric field intensity in the case of, for example, a sample thickness of 1.00 mm) can be applied, and when an overcurrent flows, the indicator "VOLTAGE SOURCE OPERATE" flashes. Then, the electrometer reduces the applied voltage and further screens an applicable voltage to automatically determine the maximum of the applied voltage. After that, the measurement is performed. A resistance value is measured from a current value after the applied voltage has been held at each of voltages obtained by dividing the maximum voltage value into five sections as respective steps for 30 seconds. In the case of, for example, a maximum applied voltage of 1,000 V, voltages are applied in such an order that a voltage is increased and then reduced by 200 V corresponding to 1/5 of the maximum applied voltage as described below: 200 V (first step), 400 V (second step), 600 V (third step), 800 V (fourth step), 1,000 V (fifth step), 1,000 V (sixth step), 800 V (seventh step), 600 V (eighth step), 400 V (ninth step), and 200 V (tenth step). A resistance value is measured from a current value after the applied voltage has been held at each step for 30 seconds.

In the case of the magnetic carrier to be used in Example 1, upon the screening, DC voltages of 1 V ($2^0$ V), 2 V ($2^1$ V), 4 V ($2^2$ V), 8 V ($2^3$ V), 16 V ($2^4$ V), 32 V ($2^5$ V), and 64 V ($2^6$ V) were each applied to the magnetic carrier for 1 second. The indicator "VOLTAGE SOURCE OPERATE" lit until 32 V, and the indicator "VOLTAGE SOURCE OPERATE" flashed at 64 V. Next, the indicator lit at a DC voltage of 45 V ($2^{5.5}$ V), and lit at a DC voltage of 52 V ($\approx 2^{5.7}$ V). Further, the maximum applicable voltage was converged, and the indicator lit at a DC voltage of 60 V ($2^{5.9}$ V). As a result, the maximum applied voltage was 60 V ($2^{5.9}$ V). DC voltages are applied in the order of 12.0 V, a value corresponding to 1/5 of 60 V (first step), 24.0 V, a value corresponding to 2/5 of 60 V (second step), 36.0 V, a value corresponding to 3/5 of 60 V (third step), 48.0 V, a value corresponding to 4/5 of 60 V (fourth step), 60.0 V, a value corresponding to 5/5 of 60 V (fifth step), 60.0 V, a value corresponding to 5/5 of 60 V (sixth step), 48.0 V, a value corresponding to 4/5 of 60 V (seventh step), 36.0 V, a value corresponding to 3/5 of 60 V (eighth step), 24.0 V, a value corresponding to 2/5 of 60 V (ninth step), and 12.0 V, a value corresponding to 1/5 of 60 V (tenth step). An electric field intensity and a specific resistance are calculated from a sample thickness of 1.04 mm and an electrode area by processing current values obtained during the application with a computer, and are then plotted in a graph. In that case, five values obtained in the course of the reduction of the voltage from the maximum applied voltage are plotted. Then, a specific resistance in an electric field intensity of 1,000 V/cm or an electric field intensity of 300 V/cm is read.

It should be noted that the specific resistance and the electric field intensity are determined by the following equations, respectively.

$$\text{Specific resistance } (\Omega\cdot\text{cm}) = (\text{Applied voltage (V)}/\text{Measured current (A)}) \times S\ (\text{cm}^2)/d\ (\text{cm})$$

$$\text{Electric field intensity (V/cm)} = \text{Applied voltage (V)}/d\ (\text{cm})$$

<Measurement of Pore Volume and Average Pore Diameter of Porous Magnetic Core Particles>

The pore volume of each of the porous magnetic core particles and the filled core particles is measured by a mercury intrusion method. A measurement principle is as described below. In the measurement, a pressure to be applied to mercury is changed and the amount of mercury that intrudes a pore at the pressure is measured. The condition under which mercury can intrude the pore can be represented by the following equation in consideration of the equilibrium of forces: $PD=-\sigma\cos\theta$ where P represents a pressure, D represents the diameter of the pore, and $\theta$ and $\sigma$ represent the contact angle and surface tension of mercury, respectively. When the contact angle and the surface tension are constants, the pressure P and the diameter D of the pore which mercury can intrude at the pressure are inversely proportional to each other. In view of the foregoing, a pore diameter distribution was determined by automatically replacing the axis of abscissa P of a P-V curve, which was obtained by measuring the amount V of the liquid to intrude at the pressure P while changing the pressure, with the pore diameter based on the equation, and then the pore volume (the shaded portion of FIG. 2B) was calculated by integrating a differential pore volume in the pore diameter range of 0.1 μm or more to 3.0 μm or less. The measurement can be performed with a measuring apparatus such as a fully automatic multifunctional mercury porosimeter PoreMaster series/PoreMaster-GT series manufactured by YUASA IONICS or an automatic porosimeter Autopore IV9500 series manufactured by Shimadzu Corporation. Specifically, the measurement was performed with an Autopore IV9520 manufactured by Shimadzu Corporation under the following conditions by the following procedure.

Measurement Conditions

"Measurement environment: 20° C."

"Measurement cell: sample volume: 53 CM, intrusion volume: 1.1 $cm^3$, application: for powder" "Measuring range: 2.0 psia (13.8 kPa) or more and 59,989.6 psia (413.7 MPa) or less"

"Measuring step: 80 steps (steps are provided so as to be arranged at an equal interval when the pore diameter is represented on a logarithmic scale)"

"Intrusion volume: regulated to be 25% or more and 70% or less"

"Low-pressure parameter; exhaust pressure: 50 μmHg, exhaustion time: 5.0 min, mercury intrusion pressure: 2.0 psia (13.8 kPa), equilibrium time: 5 secs"

"High-pressure parameter; equilibrium time: 5 secs"

"Mercury parameter; advancing contact angle: 130.0 degrees, receding contact angle: 130.0 degrees, surface tension; 485.0 mN/m (485.0 dynes/cm), mercury density; 13.5335 g/mL"

(Measurement Procedure)

(1) About 1.0 g of the porous magnetic core particles is weighed and loaded into a sample cell. Then, the weighed value is input.

(2) A mercury intrusion amount in the range of 2.0 psia (13.8 kPa) or more to 45.8 psia (315.6 kPa) or less is measured in a low-pressure portion.

(3) A mercury intrusion amount in the range of 45.9 psia (316.3 kPa) or more to 59,989.6 psia (413.6 MPa) or less is measured in a high-pressure portion.

(4) The pore diameter distribution and an average pore diameter are calculated from the mercury intrusion pressure and the mercury intrusion amount. Here, the average pore diameter is a value calculated by analysis with a software included with the apparatus, and is a value for a median pore diameter (on a volume basis) when pore diameters are specified to the range of 0.1 μm or more to 3.0 μm or less.

Figure 2A:
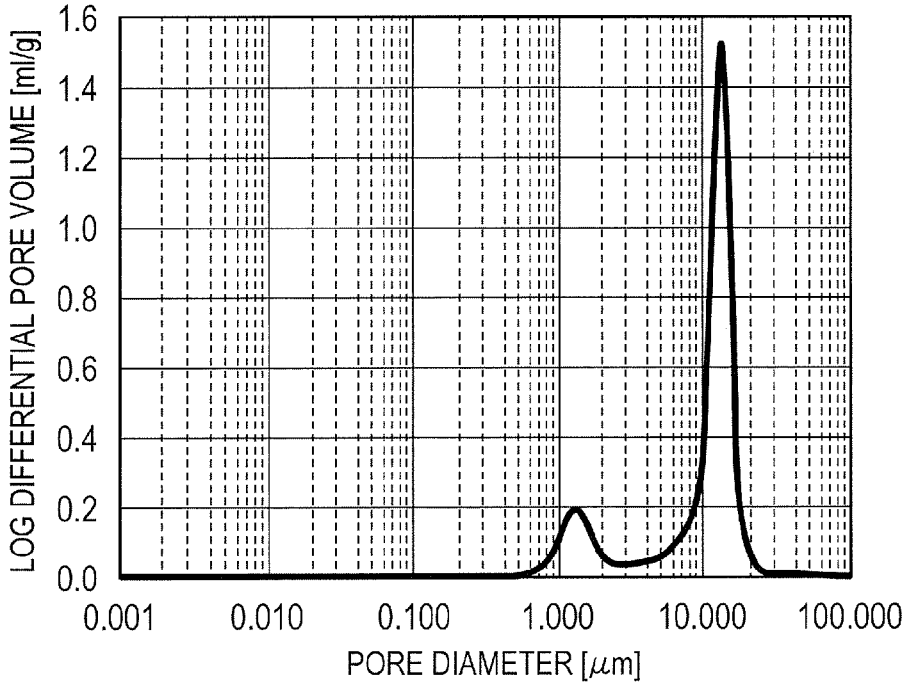
FIG. 2A illustrates an example of the result of the entire measuring region of the pore diameter distribution of porous magnetic core particles measured by a mercury intrusion method.
Figure 2B:
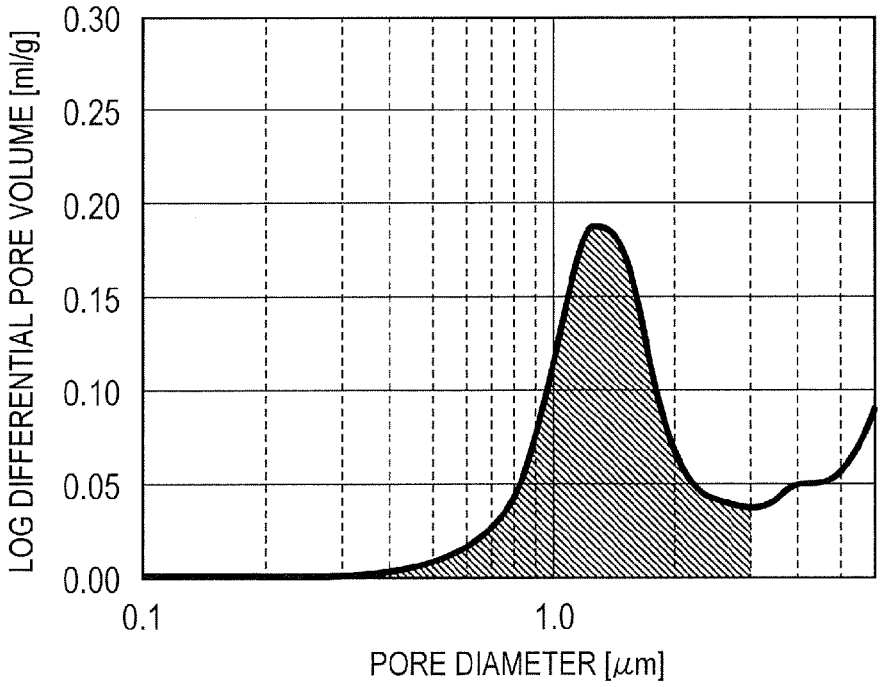
FIG. 2B illustrates an example of the result of the range of 0.1 μm or more to 3.0 μm or less of the pore diameter distribution of the porous magnetic core particles measured by the mercury intrusion method.

The foregoing steps (2), (3), and (4) were automatically performed with the software included with the apparatus. FIGS. 2A and 2B each illustrate the pore diameter distribution measured as described above. FIG. 2A illustrates a figure of the entire measuring region of the porous magnetic core particles, and FIG. 2B illustrates a figure of a portion corresponding to the range of 0.1 μm or more to 6.0 μm or less of the porous magnetic core particles cut out of the region. Here, a portion corresponding to a pore diameter of more than 6.0 μm was omitted because the portion represented a gap between the filled magnetic carrier particles, in other words, the portion did not represent a pore diameter inside the magnetic carrier. In FIG. 2B, the total pore volume (the shaded portion in the figure) was calculated by integrating the differential pore volume in the pore diameter range of 0.1 μm or more to 3.0 μm or less with the software included with the apparatus. The average pore diameter was also calculated.

<Method of Measuring Particle Size Distribution (Particle Diameter Pv Showing Maximum Frequency) of Carbon Black in Toluene Solution of Coating Resin Composition>

Only the magnetic carrier is separated from the two-component developer by the following method. The separation of the magnetic carrier from the developer is performed as described below.

The separation is performed with a charging separation type charge quantity-measuring apparatus manufactured by Etwas. The magnetic carrier can be effectively separated from the two-component developer with the measuring apparatus. 1.5 Grams of the developer were used every time the toner and the magnetic carrier were separated from each other. The developer is set in a sleeve, and then a magnet (1,000 gauss) in the sleeve is rotated for 1 minute at 2,000 rpm while an applied voltage of −4 kV is applied. As a result, only the toner flies to the inside of a cylinder (made of stainless steel) and only the magnetic carrier remains on the sleeve. The magnetic carrier can be effectively recovered from the developer by collecting the magnetic carrier.

The coating resin composition is dissolved by adding 50 ml of toluene to 0.5 g of the resultant magnetic carrier and subjecting the mixture to a dispersion treatment with a desktop ultrasonic cleaning and dispersing machine having an oscillatory frequency of 50 kHz and an electrical output of 150 W (such as a "VS-150" (manufactured by VELVO-CLEAR)) for 2 minutes. Thus, such a toluene solution of the coating resin composition that the carbon black is dispersed in toluene is obtained. It should be noted that in the case where particles except the carbon black have been added to the filling resin composition or the coating resin composition, such particles are removed before particle diameter measurement. A known method has only to be employed for the removal of the particles.

The resultant dispersion was subjected to measurement with a Microtrac particle size distribution-measuring apparatus MT3000 (NIKKISO CO., LTD.) mounted with a sample delivery controller. At the time of the measurement, the following parameters were set in the Microtrac particle size distribution-measuring apparatus MT3000.

Particle condition name: CB
Particle transparency: absorption
Set Zero: 10
Measurement time "s": 30
Number of Measurement: 2
Solvent name: toluene
Solvent refractive index: 1.50
Calculation mode: MT3000

Figure 3A:
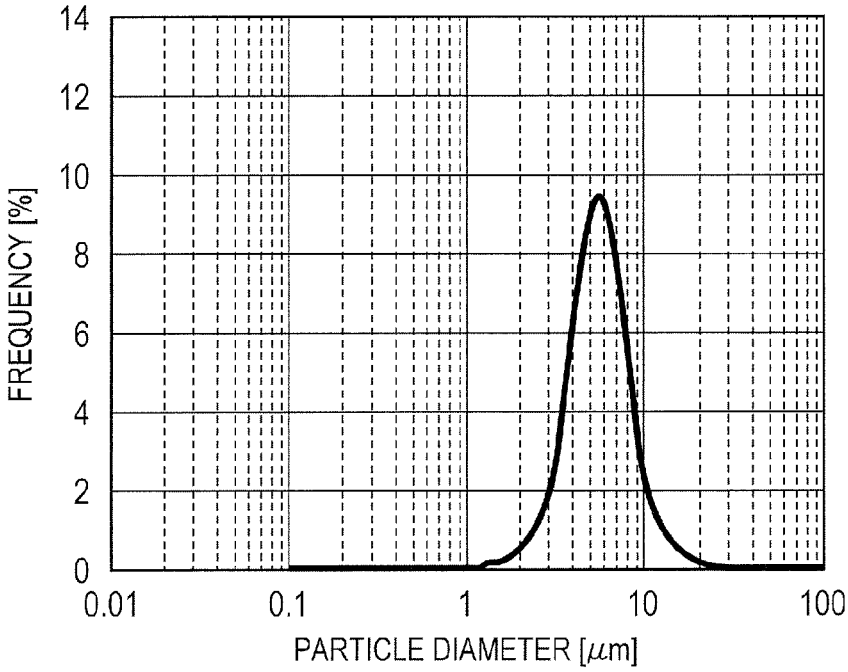
FIG. 3A illustrates an example of the particle size distribution based on a volume of carbon black in a toluene solution of a coating resin composition obtained by dispersing a magnetic carrier in toluene (an example of a maximum frequency particle diameter Pv of 1.0 μm or more and 10.0 μm or less).
Figure 3B:
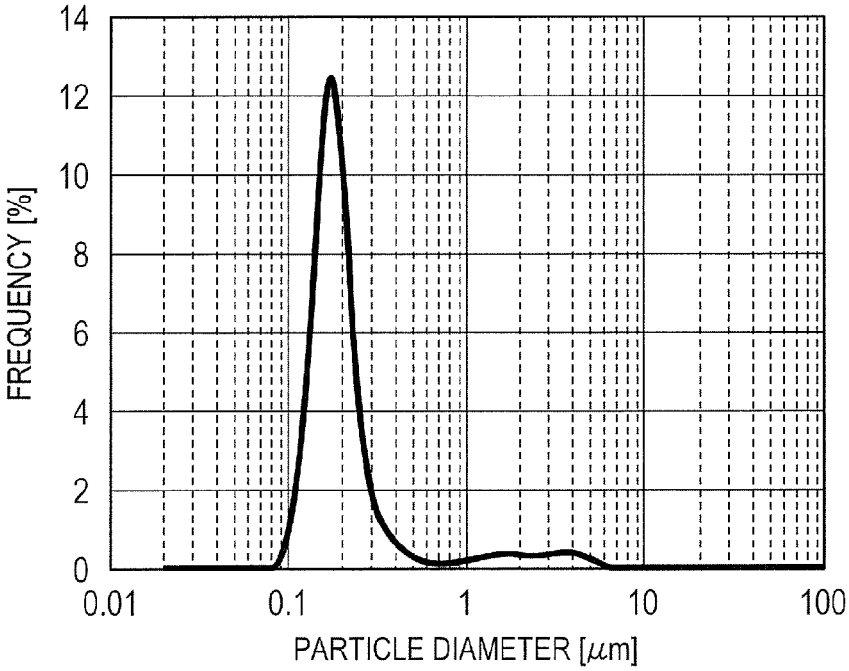
FIG. 3B illustrates an example of the particle size distribution based on a volume of carbon black in a toluene solution of a coating resin composition obtained by dispersing a magnetic carrier in toluene (an example of a maximum frequency particle diameter Pv of less than 1.0 μm).

As a result of the measurement, a frequency (%) was calculated for each particle diameter, and the particle diameter showing the maximum frequency (%) was calculated as the particle diameter Pv (μm) (FIGS. 3A and 3B).

<Method of Measuring Charge Quantity of Toner on Electrostatic Latent Image-Bearing Member>

Figure 4:
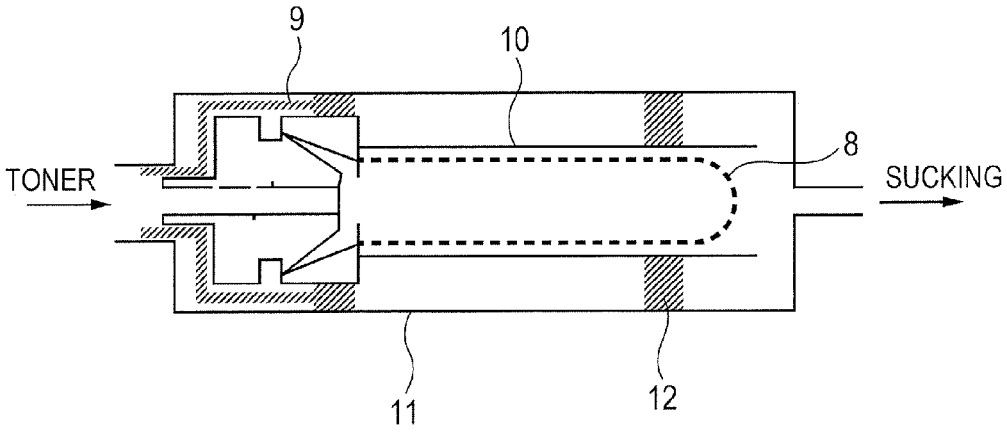
FIG. 4 is a schematic view illustrating the structure of an apparatus for measuring a toner laid-on level and charge quantity on an electrostatic latent image-bearing member.

A toner laid-on level can be calculated by sucking and collecting the toner on an electrostatic latent image-bearing member with a metal cylindrical tube and a cylindrical filter. Specifically, the triboelectric charge quantity of the toner on the electrostatic latent image-bearing member and the toner laid-on level thereon can be measured with, for example, a "Faraday cage" illustrated in FIG. 4. The Faraday cage is a coaxial double cylinder, and in FIG. 4, an inner cylinder 10 and an outer cylinder 11 are insulated from each other. In FIG. 4, the filter is represented by reference numeral 8, and the insulating member is represented by reference numerals 9 and 12. When a charged body having an electric charge quantity Q is loaded into the inner cylinder, electrostatic induction establishes a state just like a state where a metal cylinder having the electric charge quantity Q is present. The induced electric charge quantity is measured with an electrometer (Keithley 6517A manufactured by Keithley Instruments Inc.), and a value (Q/M) obtained by dividing the electric charge quantity Q (mC) by the mass M (kg) of the toner in the inner cylinder is defined as a charge quantity. In addition, an area S subjected to the suction is measured, and a value obtained by dividing the mass M of the toner by the area S ($cm^2$) subjected to the suction is defined as a toner laid-on level per unit area. The toner is subjected to the measurement as described below. The rotation of the electrostatic latent image-bearing member is stopped before a toner layer formed on the electrostatic latent image-bearing member is transferred onto an intermediate transfer member, and then a toner image on the electrostatic latent image-bearing member is directly sucked with air.

Toner laid-on level ($mg/cm^2$)=M/S
Toner charge quantity (mC/kg)=Q/M

<Method of Measuring Weight-Average Molecular Weight (Mw) of Coating Resin and Binding Resin of Toner>

A weight-average molecular weight (Mw) is measured by gel permeation chromatography (GPC) as described below.

First, a sample is dissolved in tetrahydrofuran (THF) at room temperature over 24 hours. As the sample, a coating resin or toner is used. Then, the resultant solution is filtrated through a solvent-resistant membrane filter "Maeshori Disk" (manufactured by TOSOH CORPORATION) having a pore diameter of 0.2 μm so that a sample solution may be obtained. It should be noted that the sample solution is prepared so that the concentration of components soluble in THF may be about 0.8 mass %. The measurement is performed with the sample solution under the following conditions.

Apparatus: HLC 8120 GPC (detector: RI) (manufactured by TOSOH CORPORATION)
Column: Series of seven columns, Shodex KF-801, 802, 803, 804, 805, 806, and 807 (manufactured by Showa Denko K. K.)
Eluent: tetrahydrofuran (THF)
Flow rate: 1.0 ml/min
Oven temperature: 40.0° C.
Sample injection amount: 0.10 ml In the calculation of the molecular weight of the sample, a molecular weight calibration curve prepared with standard polystyrene resins (for example, product names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

EXAMPLES

Production Example of Porous Magnetic Core Particles 1

Step 1 (Weighing/Mixing Step):

| | |
|---|---|
| $Fe_2O_3$ | 62.3 parts by mass |
| $MnCO_3$ | 28.9 parts by mass |
| $Mg(OH)_2$ | 8.2 parts by mass |
| $SrCO_3$ | 0.6 part by mass |

Ferrite raw materials were weighed so that the materials had the composition ratio. After that, the materials were pulverized and mixed with a dry vibrating mill using stainless beads each having a diameter of ⅛ inch for 5 hours.

Step 2 (Pre-Calcining Step):

The resultant pulverized product was turned into a square pellet about 1 mm on a side with a roller compactor. A coarse powder was removed from the pellet with a vibrating sieve having an aperture of 3 mm, and then a fine powder was removed therefrom with a vibrating sieve having an aperture of 0.5 mm. After that, the resultant was calcined in the air with a burner type calcining furnace at a temperature of 950° C. for 2 hours to produce a pre-calcined ferrite. The composition of the resultant pre-calcined ferrite is as described below.

$$(MnO)_a(MgO)_b(SrO)_c(Fe_2O_3)_d$$

(In the formula, a=0.319, b=0.180, c=0.005, d=0.496)

Step 3 (Pulverizing Step):

The pre-calcined ferrite was pulverized with a crusher into pieces each having a size of about 0.3 mm. After that, 30 parts by mass of water with respect to 100 parts by mass of the pre-calcined ferrite were added to the pieces, and then the mixture was pulverized with a wet ball mill using stainless beads each having a diameter of ⅛ inch for 1 hour. The resultant slurry was pulverized with a wet ball mill using stainless beads each having a diameter of 1/16 inch for 4 hours. Thus, a ferrite slurry (finely pulverized product of the pre-calcined ferrite) was obtained.

Step 4 (Granulating Step):

1.0 Part by mass of an ammonium polycarboxylate as a dispersant and 2.0 parts by mass of a polyvinyl alcohol as a binder with respect to 100 parts by mass of the pre-calcined ferrite were added to the ferrite slurry, and then the mixture was granulated into spherical particles with a spray drier (manufacturer: OHKAWARA KAKOHKI Co., LTD.). The particle sizes of the resultant particles were adjusted, and then the dispersant and the binder as organic components were removed by heating the particles with a rotary kiln at 650° C. for 2 hours.

Step 5 (Calcining Step):

In order for a calcining atmosphere to be controlled, the temperature of the resultant was increased from room temperature to a temperature of 1,150° C. in an electric furnace under a nitrogen atmosphere (having an oxygen concentration of 0.01 vol %) in 3 hours, and then the resultant was calcined at a temperature of 1,150° C. for 4 hours. After that, the temperature of the calcined product was decreased to a temperature of 60° C. over 8 hours and the nitrogen atmosphere was returned to the air. Once its temperature became 40° C. or less, the calcined product was taken out.

Step 6 (Sorting Step):

After the agglomerated particles had been shredded, a low-magnetic force product was discarded by magnetic separation, and coarse particles were removed by sieving with a sieve having an aperture of 250 μm. Thus, porous magnetic core particles 1 having a 50% particle diameter (D50) based on a volume of 35.1 μm were obtained. Table 1 shows the D50, specific resistance in an electric field intensity of 300 V/cm, pore volume, and average pore diameter of the particles.

<Production Examples of Porous Magnetic Core Particles 2 to 9 and Bulky Magnetic Core Particles 1>

Porous magnetic core particles 2 to 9 and bulky magnetic core particles 1 were obtained in the same manner as in the production example of the porous magnetic core particles 1 except that such a change as shown in Table 1 was made. Table 1 shows the D50, specific resistances in an electric field intensity of 300 V/cm, total pore volumes, and average pore diameters of the particles.

TABLE 1

Physical properties of porous magnetic core particles and bulky magnetic core particles

| | Step 1 (weighing/mixing step) Raw material composition (mass %) | | | | Step 2 (pre-calcining step) Pre-calcined | Step 3 (pulverizing step) Ball mill | | Step 4 (granulaing step) |
|---|---|---|---|---|---|---|---|---|
| | $Fe_2O_3$ | $MnCO_3$ | $Mg(OH)_2$ | $SrCO_3$ | ferrite | Beads (1/16 inch) | Time | PVA (part(s) by mass) |
| Porous magnetic core particles 1 | 62.3 | 28.9 | 8.2 | 0.6 | $(MnO)_{0.319}(MgO)_{0.180}(SrO)_{0.005}(Fe_2O_3)_{0.496}$ | Stainless steel | 4.0 | 2.0 |
| Porous magnetic core particles 2 | 83.1 | 9.5 | 6.2 | 1.2 | $(MnO)_{0.115}(MgO)_{0.149}(SrO)_{0.011}(Fe_2O_3)_{0.725}$ | Stainless steel | 4.0 | 1.0 |
| Porous magnetic core particles 3 | 83.1 | 9.5 | 6.2 | 1.2 | $(MnO)_{0.115}(MgO)_{0.149}(SrO)_{0.011}(Fe_2O_3)_{0.725}$ | Stainless steel | 4.0 | 0.5 |
| Porous magnetic core particles 4 | 62.3 | 28.9 | 8.2 | 0.6 | $(MnO)_{0.319}(MgO)_{0.180}(SrO)_{0.005}(Fe_2O_3)_{0.496}$ | Stainless steel | 4.0 | 2.0 |
| Porous magnetic core particles 5 | 62.3 | 28.9 | 8.2 | 0.6 | $(MnO)_{0.319}(MgO)_{0.180}(SrO)_{0.005}(Fe_2O_3)_{0.496}$ | Stainless steel | 4.0 | 2.0 |
| Porous magnetic core particles 6 | 62.3 | 28.9 | 8.2 | 0.6 | $(MnO)_{0.319}(MgO)_{0.180}(SrO)_{0.005}(Fe_2O_3)_{0.496}$ | Zirconia | 6.0 | 2.0 |
| Porous magnetic core particles 7 | 62.3 | 28.9 | 8.2 | 0.6 | $(MnO)_{0.319}(MgO)_{0.180}(SrO)_{0.005}(Fe_2O_3)_{0.496}$ | Alumina | 1.0 | 2.0 |
| Porous magnetic core particles 8 | 62.3 | 28.9 | 8.2 | 0.6 | $(MnO)_{0.319}(MgO)_{0.180}(SrO)_{0.005}(Fe_2O_3)_{0.496}$ | Stainless steel | 4.0 | 2.0 |
| Porous magnetic core particles 9 | 62.3 | 28.9 | 8.2 | 0.6 | $(MnO)_{0.319}(MgO)_{0.180}(SrO)_{0.005}(Fe_2O_3)_{0.496}$ | Stainless steel | 4.0 | 2.0 |
| Bulky magnetic core particles 1 | 62.3 | 28.9 | 8.2 | 0.6 | $(MnO)_{0.319}(MgO)_{0.180}(SrO)_{0.005}(Fe_2O_3)_{0.496}$ | Stainless steel | 4.0 | 2.0 |

TABLE 1-continued

Physical properties of porous magnetic core particles and bulky magnetic core particles

| | Step 5 (calcining step) Electric furnace | | | 50% particle diameter | Specific resistance in electric field | Average | Pore |
|---|---|---|---|---|---|---|---|
| | Calcining temperature (° C.) | Calcining time (h) | Atmosphere (oxygen concentration) | based on volume D50 [μm] | intensity of 300 V/cm [Ω · cm] | pore diameter [μm] | volume value [$mm^3/g$] |
| Porous magnetic core particles 1 | 1,150 | 4 | 0.01 | 35.1 | $3.0 \times 10^6$ | 1.1 | 63.2 |
| Porous magnetic core particles 2 | 1,150 | 4 | 0.01 | 50.4 | $8.2 \times 10^5$ | 1.0 | 62.5 |
| Porous magnetic core particles 3 | 1,150 | 4 | 0.01 | 60.1 | $7.4 \times 10^5$ | 1.1 | 64.3 |
| Porous magnetic core particles 4 | 1,150 | 4 | 0.50 | 35.0 | $8.8 \times 10^6$ | 1.0 | 62.8 |
| Porous magnetic core particles 5 | 1,150 | 4 | 1.00 | 35.0 | $2.0 \times 10^7$ | 1.0 | 62.8 |
| Porous magnetic core particles 6 | 1,150 | 4 | 0.01 | 35.4 | $2.8 \times 10^6$ | 0.8 | 61.8 |
| Porous magnetic core particles 7 | 1,150 | 4 | 0.01 | 35.4 | $2.9 \times 10^6$ | 1.4 | 64.4 |
| Porous magnetic core particles 8 | 1,200 | 4 | 0.01 | 35.3 | $2.7 \times 10^6$ | 1.1 | 35.6 |
| Porous magnetic core particles 9 | 1,100 | 4 | 0.01 | 35.3 | $2.6 \times 10^6$ | 1.1 | 94.3 |
| Bulky magnetic core particles 1 | 1,350 | 4 | 0.01 | 32.4 | $1.6 \times 10^6$ | — | — |

<Preparation of Silicone Resin Solution 1>

A silicone resin solution 1 was obtained by mixing the following components for 1 hour.

| | |
|---|---|
| KR251 (manufactured by Shin-Etsu Chemical Co., Ltd., resin solid content concentration: 20%) | 50.0 mass % |
| Toluene | 49.5 mass % |
| 3-Aminopropyltrimethoxysilane | 0.5 mass % |

<Preparation of Silicone Resin Solution 2>

A silicone resin solution 2 was obtained by mixing the following components for 1 hour.

| | |
|---|---|
| KR5208 (manufactured by Shin-Etsu Chemical Co., Ltd., resin solid content concentration: 20%) | 50.0 mass % |
| Toluene | 49.5 mass % |
| Dimethoxymethylvinylsilane | 0.5 mass % |

<Preparation of Polymer Solution 1>

| | |
|---|---|
| Cyclohexyl methacrylate monomer | 26.8 mass % |
| Methyl methacrylate monomer | 0.2 mass % |
| Methyl methacrylate macromonomer (a macromonomer having a methacryloyl group at one terminal and having a weight-average molecular weight of 5,000) | 8.4 mass % |
| Toluene | 31.3 mass % |
| Methyl ethyl ketone | 31.3 mass % |
| Azobisisobutyronitrile | 2.0 mass % |

Of the materials, the cyclohexyl methacrylate, the methyl methacrylate, the methyl methacrylate macromonomer, the toluene, and the methyl ethyl ketone were added to a four-necked separable flask mounted with a reflux condenser, a temperature gauge, a nitrogen-introducing tube, and a stirring apparatus, and then a nitrogen gas was introduced into the flask to sufficiently replace the air in the flask with a nitrogen atmosphere. After that, the temperature of the mixture was increased to 80° C., azobisisobutyronitrile was added to the mixture, and the whole was polymerized by being refluxed for 5 hours. Hexane was injected into the resultant reaction product to precipitate a copolymer, and then the precipitate was separated by filtration. After that, the precipitate was vacuum-dried to provide a coating resin 1. 30 Parts by mass of the resultant coating resin 1 were dissolved in 40 parts by mass of toluene and 30 parts by mass of methyl ethyl ketone. Thus, a polymer solution 1 (having a solid content of 30 mass %) was obtained. Table 2 shows the physical properties of the resultant coating resin 1.

<Preparation of Polymer Solutions 2 to 6>

Polymer solutions 2 to 6 were prepared in the same manner as in the preparation of the polymer solution 1 except that such a change as shown in Table 2 was made.

<Preparation of Coating Resin Solution 1>

| | |
|---|---|
| Polymer solution 1 (resin solid content concentration: 30%) | 65.0 mass % |
| Toluene | 31.0 mass % |

-continued

| | |
|---|---|
| Carbon black (Regal 330; manufactured by Cabot Corporation) (Primary particle diameter: 25 nm, nitrogen adsorption specific surface area: 94 $m^2/g$, DBP oil absorption: 75 ml/100 g) | 4.0 mass % |

The materials were dispersed with a paint shaker using zirconia beads each having a diameter of 0.5 mm for 1 hour. The resultant dispersion was filtered through a 5.0-μm membrane filter. Thus, a coating resin solution 1 was obtained.

<Preparation of Coating Resin Solutions 2 to 9 and Coating Resin Solutions 11 to 14>

Coating resin solutions 2 to 9 and coating resin solutions 11 to 14 were prepared in the same manner as in the preparation of the coating resin solution 1 except that such a change as shown in Table 3 was made.

<Preparation of Coating Resin Solution 10>

A coating resin solution 10 was prepared in the same manner as in the preparation of the coating resin solution 1 except that the carbon black was changed to the following carbon black.

Carbon black (#25; manufactured by Mitsubishi Chemical Corporation) (average primary particle diameter: 47 nm, nitrogen adsorption specific surface area: 55 $m^2/g$, DBP oil absorption: 66 ml/100 g)

TABLE 2

Preparation of coating resin

| Coating resin | Monomer 1 | Mass % | Monomer 2 | Mass % | Monomer 3 | Mass % | Weight-average molecular weight Mw |
|---|---|---|---|---|---|---|---|
| Coating resin 1 | Cyclohexyl methacrylate monomer | 26.8 | Methyl methacrylate monomer | 0.2 | Methyl methacrylate macromonomer | 8.4 | 60,000 |
| Coating resin 2 | Cyclohexyl methacrylate monomer | 26.8 | Methyl methacrylate monomer | 0.2 | Styrene macromonomer | 8.4 | 55,000 |
| Coating resin 3 | Cyclohexyl methacrylate monomer | 34.7 | Methyl methacrylate monomer | 0.7 | — | — | 43,000 |
| Coating resin 4 | Adamantyl methacrylate monomer | 34.7 | Methyl methacrylate monomer | 0.7 | — | — | 51,000 |
| Coating resin 5 | Methyl methacrylate monomer | 35.4 | — | — | — | — | 40,000 |
| Coating resin 6 | Methyl methacrylate monomer | 28.3 | Styrene monomer | 7.1 | — | — | 56,000 |

TABLE 3

Preparation of coating resin solution

| Coating resin solution | Polymer solution | Mass % | Carbon black | Mass % | Solvent | Mass % |
|---|---|---|---|---|---|---|
| Coating resin solution 1 | Polymer solution 1 | 65.0 | Regal 330 (manufactured by Cabot Corporation) | 4.0 | Toluene | 31.0 |
| Coating resin solution 2 | Polymer solution 2 | 65.0 | Regal 330 (manufactured by Cabot Corporation) | 4.0 | Toluene | 31.0 |
| Coating resin solution 3 | Polymer solution 3 | 65.0 | Regal 330 (manufactured by Cabot Corporation) | 4.0 | Toluene | 31.0 |
| Coating resin solution 4 | Polymer solution 4 | 65.0 | Regal 330 (manufactured by Cabot Corporation) | 4.0 | Toluene | 31.0 |
| Coating resin solution 5 | Polymer solution 5 | 65.0 | Regal 330 (manufactured by Cabot Corporation) | 4.0 | Toluene | 31.0 |

TABLE 3-continued

| Preparation of coating resin solution | | | | | | |
|---|---|---|---|---|---|---|
| Coating resin solution | Polymer solution | Mass % | Carbon black | Mass % | Solvent | Mass % |
| Coating resin solution 6 | Polymer solution 5 | 65.0 | Regal 330 (manufactured by Cabot Corporation) | 2.0 | Toluene | 33.0 |
| Coating resin solution 7 | Polymer solution 5 | 65.0 | Regal 330 (manufactured by Cabot Corporation) | 6.0 | Toluene | 29.0 |
| Coating resin solution 8 | Polymer solution 5 | 65.0 | Regal 330 (manufactured by Cabot Corporation) | 1.8 | Toluene | 33.2 |
| Coating resin solution 9 | Polymer solution 5 | 65.0 | Regal 330 (manufactured by Cabot Corporation) | 6.2 | Toluene | 28.8 |
| Coating resin solution 10 | Polymer solution 5 | 65.0 | #25 (manufactured by Mitsubishi Chemical Corporation) | 6.2 | Toluene | 28.8 |
| Coating resin solution 11 | Polymer solution 6 | 65.0 | Regal 330 (manufactured by Cabot Corporation) | 6.2 | Toluene | 28.8 |
| Coating resin solution 12 | Polymer solution 5 | 65.0 | Regal 330 (manufactured by Cabot Corporation) | 0.6 | Toluene | 34.4 |
| Coating resin solution 13 | Polymer solution 5 | 65.0 | Regal 330 (manufactured by Cabot Corporation) | 8.0 | Toluene | 27.0 |
| Coating resin solution 14 | Polymer solution 5 | 65.0 | — | — | Toluene | 35.0 |

<Production of Magnetic Carrier 1>

Step 1 (Resin Filling Step):

100.0 Parts by mass of the porous magnetic core particles 1 were loaded into the stirring container of a mixing stirrer (universal stirrer model NDMV manufactured by Dalton Co., Ltd.). While the temperature in the container was kept at 60° C., the pressure in the container was reduced to 2.3 kPa. During the decompression, nitrogen was introduced into the container and then the silicone resin solution 1 was dropped under reduced pressure so that its amount in terms of a resin component was 7.5 parts by mass with respect to the porous magnetic core particles 1. After the completion of the dropping, the mixture was continuously stirred for 2 hours without being subjected to any other treatment. After that, the temperature was increased to 70° C. and then the solvent was removed under reduced pressure. Thus, a silicone resin composition obtained from the silicone resin solution 1 was filled into the particles of the porous magnetic core particles 1. After having been cooled, the resultant filled core particles were moved to a mixer having a spiral blade in a rotatable mixing container (drum mixer model UD-AT manufactured by SUGIYAMA HEAVY INDUSTRIAL CO., LTD.), and then their temperature was increased to 220° C. under a nitrogen atmosphere and normal pressure at a rate of temperature increase of 2° C./min. The resin was cured by heating and stirring the particles at this temperature for 60 minutes. After the heat treatment, a low-magnetic force product was separated by magnetic separation and then the resultant was classified with a sieve having an aperture of 150 μm. Thus, filled core particles 1 were obtained. Table 5 shows the 50% particle diameter (D50) based on a volume, specific resistance in an electric field intensity of 1,000 V/cm, and pore volume of the particles.

Step 2 (Resin Coating Step):

Subsequently, the coating resin solution 1 was charged into a vacuum deaeration type kneader maintained at normal temperature so that its amount in terms of a resin component was 2.5 parts by mass with respect to 100 parts by mass of the filled core particles 1. After having been charged, the solution was stirred at a rotational speed of 30 rpm for 15 minutes. After a certain amount (80 mass %) or more of the solvent had been volatilized, the temperature in the kneader was increased to 80° C. while the remaining contents were mixed under reduced pressure. Toluene was removed by distillation over 2 hours and then the resultant was cooled. A low-magnetic force product was separated from the resultant magnetic carrier by magnetic separation and then the resultant was passed through a sieve having an aperture of 70 μm. After that, the resultant was classified with an air classifier. Thus, a magnetic carrier 1 having a 50% particle diameter (D50) based on a volume of 38.2 μm was obtained. Table 5 shows the physical properties of the resultant magnetic carrier.

<Production of Magnetic Carriers 2 to 29>

Magnetic carriers 2 to 29 were produced in the same manner as in the production example of the magnetic carrier 1 except that such a change as shown in Table 4 was made. Table 5 shows the physical properties of the resultant magnetic carriers.

<Production of Magnetic Carrier 30>

The filled core particles 1 were obtained in the same manner as in the step 1 out of the production example of the magnetic carrier 1.

Step 2 (Resin Coating Step):

Subsequently, the coating resin solution 8 was charged into a planetary-screw mixer (Naute mixer model VN manufactured by Hosokawa Micron Corporation) maintained at 60° C. under reduced pressure (1.5 kPa) so that its amount in terms of a resin component was 2.5 parts by mass with respect to 100 parts by mass of the filled core particles 1. How to charge the resin solution is as described below. One third of the amount of the resin solution was charged, and then toluene removal and an applying operation were performed for 20 minutes. Next, another one third of the amount of the resin solution was charged, and then the toluene removal and the applying operation were performed for 20 minutes. Further, the remaining one third of the amount of the resin solution was charged, and then the toluene removal and the applying operation were performed for 20 minutes. After that, the magnetic carrier coated with the coating resin composition was moved to a mixer having a spiral blade in a rotatable mixing container (drum mixer model UD-AT manufactured by SUGIYAMA HEAVY INDUSTRIAL CO., LTD.), and was then subjected to a heat treatment at a temperature of 200° C. under a nitrogen atmosphere for 2 hours while being stirred by rotating the mixing container 10 times per 1 minute. A low-magnetic force product was separated from the resultant magnetic carrier by magnetic separation and then the resultant was passed through a sieve having an aperture of 70 μm. After that, the resultant was classified with an air classifier. Thus, a magnetic carrier 30 having a 50% particle diameter (D50) based on a volume of 38.3 μm was obtained. Table 5 shows the physical properties of the resultant magnetic carrier.

TABLE 4

| Formulation of magnetic carrier | | | | | | | |
|---|---|---|---|---|---|---|---|
| | | Resin filling step | | | Resin coating step | | |
| Magnetic carrier | Porous magnetic core particles | Resin solution | Amount of filling resin | Filled core particles | Apparatus | Coating resin solution | Coating amount |
| Magnetic carrier 1 | Porous magnetic core particles 1 | Silicone resin solution 1 | 7.5 parts by mass | Filled core particles 1 | Vacuum deaeration kneader | Coating resin solution 1 | 2.5 parts by mass |
| Magnetic carrier 2 | Porous magnetic core particles 1 | Silicone resin solution 1 | 7.5 parts by mass | Filled core particles 1 | Vacuum deaeration kneader | Coating resin solution 2 | 2.5 parts by mass |
| Magnetic carrier 3 | Porous magnetic core particles 1 | Silicone resin solution 1 | 7.5 parts by mass | Filled core particles 1 | Vacuum deaeration kneader | Coating resin solution 3 | 2.5 parts by mass |
| Magnetic carrier 4 | Porous magnetic core particles 1 | Silicone resin solution 1 | 7.5 parts by mass | Filled core particles 1 | Vacuum deaeration kneader | Coating resin solution 4 | 2.5 parts by mass |
| Magnetic carrier 5 | Porous magnetic core particles 1 | Silicone resin solution 1 | 7.5 parts by mass | Filled core particles 1 | Vacuum deaeration kneader | Coating resin solution 5 | 2.5 parts by mass |
| Magnetic carrier 6 | Porous magnetic core particles 1 | Silicone resin solution 1 | 7.5 parts by mass | Filled core particles 1 | Vacuum deaeration kneader | Coating resin solution 6 | 2.5 parts by mass |
| Magnetic carrier 7 | Porous magnetic core particles 1 | Silicone resin solution 1 | 7.5 parts by mass | Filled core particles 1 | Vacuum deaeration kneader | Coating resin solution 7 | 2.5 parts by mass |
| Magnetic carrier 8 | Porous magnetic core particles 1 | Silicone resin solution 1 | 7.5 parts by mass | Filled core particles 1 | Vacuum deaeration kneader | Coating resin solution 8 | 2.5 parts by mass |
| Magnetic carrier 9 | Porous magnetic core particles 1 | Silicone resin solution 1 | 7.5 parts by mass | Filled core particles 1 | Vacuum deaeration kneader | Coating resin solution 9 | 2.5 parts by mass |
| Magnetic carrier 10 | Porous magnetic core particles 1 | Silicone resin solution 1 | 7.5 parts by mass | Filled core particles 1 | Vacuum deaeration kneader | Coating resin solution 10 | 2.5 parts by mass |
| Magnetic carrier 11 | Porous magnetic core particles 1 | Silicone resin solution 1 | 7.5 parts by mass | Filled core particles 1 | Vacuum deaeration kneader | Coating resin solution 11 | 2.5 parts by mass |
| Magnetic carrier 12 | Porous magnetic core particles 1 | Silicone resin solution 2 | 7.5 parts by mass | Filled core particles 2 | Vacuum deaeration kneader | Coating resin solution 9 | 2.5 parts by mass |
| Magnetic carrier 13 | Porous magnetic core particles 2 | Silicone resin solution 1 | 7.5 parts by mass | Filled core particles 3 | Vacuum deaeration kneader | Coating resin solution 9 | 2.4 parts by mass |
| Magnetic carrier 14 | Porous magnetic core particles 3 | Silicone resin solution 1 | 7.5 parts by mass | Filled core particles 4 | Vacuum deaeration kneader | Coating resin solution 9 | 2.1 parts by mass |
| Magnetic carrier 15 | Porous magnetic core particles 4 | Silicone resin solution 1 | 7.5 parts by mass | Filled core particles 5 | Vacuum deaeration kneader | Coating resin solution 9 | 2.5 parts by mass |
| Magnetic carrier 16 | Porous magnetic core particles 5 | Silicone resin solution 1 | 7.5 parts by mass | Filled core particles 6 | Vacuum deaeration kneader | Coating resin solution 9 | 2.5 parts by mass |
| Magnetic carrier 17 | Porous magnetic core particles 6 | Silicone resin solution 1 | 7.5 parts by mass | Filled core particles 7 | Vacuum deaeration kneader | Coating resin solution 9 | 2.5 parts by mass |
| Magnetic carrier 18 | Porous magnetic core particles 7 | Silicone resin solution 1 | 7.5 parts by mass | Filled core particles 8 | Vacuum deaeration kneader | Coating resin solution 9 | 2.5 parts by mass |
| Magnetic carrier 19 | Porous magnetic core particles 8 | Silicone resin solution 1 | 3.0 parts by mass | Filled core particles 9 | Vacuum deaeration kneader | Coating resin solution 9 | 2.5 parts by mass |
| Magnetic carrier 20 | Porous magnetic core particles 9 | Silicone resin solution 1 | 9.0 parts by mass | Filled core particles 10 | Vacuum deaeration kneader | Coating resin solution 9 | 2.5 parts by mass |
| Magnetic carrier 21 | Porous magnetic core particles 1 | Silicone resin solution 1 | 8.5 parts by mass | Filled core particles 11 | Vacuum deaeration kneader | Coating resin solution 9 | 2.5 parts by mass |
| Magnetic carrier 22 | Porous magnetic core particles 1 | Silicone resin solution 1 | 6.0 parts by mass | Filled core particles 12 | Vacuum deaeration kneader | Coating resin solution 9 | 2.5 parts by mass |
| Magnetic carrier 23 | Porous magnetic core particles 1 | Silicone resin solution 1 | 7.5 parts by mass | Filled core particles 1 | Vacuum deaeration kneader | Coating resin solution 8 | 2.0 parts by mass |
| Magnetic carrier 24 | Porous magnetic core particles 1 | Silicone resin solution 1 | 7.5 parts by mass | Filled core particles 1 | Vacuum deaeration kneader | Coating resin solution 9 | 5.0 parts by mass |
| Magnetic carrier 25 | Porous magnetic core particles 1 | Silicone resin solution 1 | 7.5 parts by mass | Filled core particles 1 | Vacuum deaeration kneader | Coating resin solution 12 | 2.5 parts by mass |
| Magnetic carrier 26 | Porous magnetic core particles 1 | Silicone resin solution 1 | 7.5 parts by mass | Filled core particles 1 | Vacuum deaeration kneader | Coating resin solution 13 | 2.5 parts by mass |
| Magnetic carrier 27 | Bulky magnetic core particles 1 | — | — | Bulky magnetic core particles 1 | Vacuum deaeration kneader | Coating resin solution 8 | 2.5 parts by mass |
| Magnetic carrier 28 | Porous magnetic core particles 1 | Silicone resin solution 1 | 7.5 parts by mass | Filled core particles 1 | Vacuum deaeration kneader | Coating resin solution 14 | 2.5 parts by mass |
| Magnetic carrier 29 | Porous magnetic core particles 1 | Silicone resin solution 1 | 7.5 parts by mass | Filled core particles 1 | Vacuum deaeration kneader | Coating resin solution 8 | 1.9 parts by mass |
| Magnetic carrier 30 | Porous magnetic core particles 1 | Silicone resin solution 1 | 7.5 parts by mass | Filled core particles 1 | Planetary-screw mixer | Coating resin solution 8 | 2.5 parts by mass |

TABLE 5

| Physical properties of magnetic carrier | | | | | | | | | | | | |
|---|---|---|---|---|---|---|---|---|---|---|---|---|
| | Magnetic core particles | | | | | Filled core particles | | | | Magnetic carrier particles | | |
| Magnetic carrier | Porous magnetic core particles/ bulky magnetic core particles | Particle diameter D50 [μm] | Specific resistance in electric field intensity of 300 V/cm [Ω · cm] | Average pore diameter [μm] | Pore volume [$mm^3/g$] | Filled core particles | Particle diameter D50 [μm] | Filling ratio [vol %] | Specific resistance in electric field intensity of 1,000 V/cm [Ω · cm] | Particle diameter D50 [μm] | Particle diameter Pv [μm] | Specific resistance in electric field intensity of 1,000 V/cm [Ω · cm] |
| 1 | 1 | 35.1 | $3.0 \times 10^6$ | 1.1 | 63.2 | 1 | 35.4 | 80 | $8.5 \times 10^5$ | 38.2 | 7.0 | $1.6 \times 10^6$ |
| 2 | 1 | 35.1 | $3.0 \times 10^6$ | 1.1 | 63.2 | 1 | 35.4 | 80 | $8.5 \times 10^5$ | 38.3 | 6.9 | $1.7 \times 10^6$ |
| 3 | 1 | 35.1 | $3.0 \times 10^6$ | 1.1 | 63.2 | 1 | 35.4 | 80 | $8.5 \times 10^5$ | 38.4 | 6.8 | $1.6 \times 10^6$ |
| 4 | 1 | 35.1 | $3.0 \times 10^6$ | 1.1 | 63.2 | 1 | 35.4 | 80 | $8.5 \times 10^5$ | 38.2 | 6.9 | $1.8 \times 10^6$ |
| 5 | 1 | 35.1 | $3.0 \times 10^6$ | 1.1 | 63.2 | 1 | 35.4 | 80 | $8.5 \times 10^5$ | 38.5 | 6.7 | $1.6 \times 10^6$ |
| 6 | 1 | 35.1 | $3.0 \times 10^6$ | 1.1 | 63.2 | 1 | 35.4 | 80 | $8.5 \times 10^5$ | 38.2 | 4.8 | $1.9 \times 10^6$ |
| 7 | 1 | 35.1 | $3.0 \times 10^6$ | 1.1 | 63.2 | 1 | 35.4 | 80 | $8.5 \times 10^5$ | 38.3 | 8.1 | $1.4 \times 10^6$ |
| 8 | 1 | 35.1 | $3.0 \times 10^6$ | 1.1 | 63.2 | 1 | 35.4 | 80 | $8.5 \times 10^5$ | 38.0 | 3.9 | $2.0 \times 10^6$ |
| 9 | 1 | 35.1 | $3.0 \times 10^6$ | 1.1 | 63.2 | 1 | 35.4 | 80 | $8.5 \times 10^5$ | 38.1 | 8.5 | $1.3 \times 10^6$ |
| 10 | 1 | 35.1 | $3.0 \times 10^6$ | 1.1 | 63.2 | 1 | 35.4 | 80 | $8.5 \times 10^5$ | 38.3 | 8.5 | $1.3 \times 10^6$ |
| 11 | 1 | 35.1 | $3.0 \times 10^6$ | 1.1 | 63.2 | 1 | 35.4 | 80 | $8.5 \times 10^5$ | 38.4 | 8.6 | $1.4 \times 10^6$ |
| 12 | 1 | 35.1 | $3.0 \times 10^6$ | 1.1 | 63.2 | 2 | 35.2 | 81 | $8.3 \times 10^5$ | 38.5 | 8.5 | $1.3 \times 10^6$ |
| 13 | 2 | 50.4 | $8.2 \times 10^5$ | 1.0 | 62.5 | 3 | 51.3 | 80 | $2.5 \times 10^5$ | 52.6 | 8.4 | $9.7 \times 10^5$ |
| 14 | 3 | 60.1 | $7.4 \times 10^5$ | 1.1 | 64.3 | 4 | 60.9 | 79 | $2.1 \times 10^5$ | 63.5 | 8.5 | $9.1 \times 10^5$ |
| 15 | 4 | 35.0 | $8.8 \times 10^6$ | 1.0 | 62.8 | 5 | 35.3 | 78 | $8.8 \times 10^6$ | 38.0 | 8.5 | $2.7 \times 10^7$ |
| 16 | 5 | 35.0 | $2.0 \times 10^7$ | 1.0 | 62.6 | 6 | 36.2 | 79 | $9.8 \times 10^6$ | 38.6 | 8.6 | $5.7 \times 10^7$ |
| 17 | 6 | 35.4 | $2.8 \times 10^6$ | 0.8 | 61.8 | 7 | 35.5 | 82 | $5.9 \times 10^5$ | 38.4 | 8.4 | $1.2 \times 10^6$ |
| 18 | 7 | 35.4 | $2.9 \times 10^6$ | 1.4 | 64.4 | 8 | 35.4 | 80 | $5.7 \times 10^5$ | 38.0 | 8.7 | $1.3 \times 10^6$ |
| 19 | 8 | 35.3 | $2.7 \times 10^6$ | 1.1 | 35.6 | 9 | 35.9 | 81 | $2.5 \times 10^5$ | 38.1 | 8.6 | $1.3 \times 10^6$ |
| 20 | 9 | 35.3 | $2.6 \times 10^6$ | 1.1 | 94.2 | 10 | 36.1 | 80 | $9.5 \times 10^5$ | 38.1 | 8.5 | $1.4 \times 10^6$ |
| 21 | 1 | 35.1 | $3.0 \times 10^6$ | 1.1 | 63.2 | 11 | 36.8 | 89 | $9.9 \times 10^5$ | 39.3 | 8.5 | $3.3 \times 10^6$ |
| 22 | 1 | 35.1 | $3.0 \times 10^6$ | 1.1 | 63.2 | 12 | 35.2 | 62 | $5.5 \times 10^5$ | 37.8 | 4.8 | $1.1 \times 10^6$ |
| 23 | 1 | 35.1 | $3.0 \times 10^6$ | 1.1 | 63.2 | 1 | 35.4 | 80 | $8.6 \times 10^5$ | 37.4 | 4.7 | $1.5 \times 10^6$ |
| 24 | 1 | 35.1 | $3.0 \times 10^6$ | 1.1 | 63.2 | 1 | 35.4 | 80 | $8.6 \times 10^5$ | 39.1 | 1.2 | $1.6 \times 10^6$ |
| 25 | 1 | 35.1 | $3.0 \times 10^6$ | 1.1 | 63.2 | 1 | 35.4 | 80 | $8.6 \times 10^5$ | 38.5 | 9.9 | $2.1 \times 10^6$ |
| 26 | 1 | 35.1 | $3.0 \times 10^6$ | 1.1 | 63.2 | 1 | 35.4 | 80 | $9.6 \times 10^5$ | 38.4 | 4.5 | $1.1 \times 10^6$ |
| 27 | Bulk 1 | 32.4 | $1.6 \times 10^6$ | — | — | Bulk 1 | 34.2 | — | $1.6 \times 10^5$ | 36.1 | 4.5 | $9.5 \times 10^7$ |
| 28 | 1 | 35.1 | $3.0 \times 10^6$ | 1.1 | 63.2 | 1 | 35.4 | 80 | $8.6 \times 10^5$ | 38.4 | — | $5.6 \times 10^7$ |
| 29 | 1 | 35.1 | $3.0 \times 10^6$ | 1.1 | 63.2 | 1 | 35.4 | 80 | $8.6 \times 10^5$ | 38.3 | 4.9 | $3.1 \times 10^6$ |
| 30 | 1 | 35.1 | $3.0 \times 10^6$ | 1.1 | 63.2 | 1 | 35.4 | 80 | $8.6 \times 10^5$ | 38.3 | 0.3 | $4.2 \times 10^7$ |

<Production Example of Polyester Resin 1>

| | |
|---|---|
| Terephthalic acid | 299 parts by mass |
| Trimellitic anhydride | 19 parts by mass |
| Polyoxypropylene (2.2)-2,2-bis (4-hydroxyphenyl) propane | 747 parts by mass |
| Titanium dihydroxybis (triethanolaminate) | 1 part by mass |

The materials were weighed in a reaction tank provided with a cooling tube, a stirrer, and a nitrogen-introducing tube. After that, the mixture was heated to a temperature of 200° C. and then subjected to a reaction for 10 hours while nitrogen was introduced into the tank and water to be produced was removed. After that, the pressure in the tank was reduced to 10 mmHg and then the mixture was subjected to a reaction for 1 hour. Thus, a polyester resin 1 having a weight-average molecular weight (Mw) of 6,000 was obtained.

<Production Example of Polyester Resin 2>

| | |
|---|---|
| Terephthalic acid | 332 parts by mass |
| Polyoxyethylene (2.2)-2,2-bis (4-hydroxyphenyl) propane | 996 parts by mass |
| Titanium dihydroxybis (triethanolaminate) | 1 part by mass |

The materials were weighed in a reaction tank provided with a cooling tube, a stirrer, and a nitrogen-introducing tube. After that, the mixture was heated to 220° C. and then subjected to a reaction for 10 hours while nitrogen was introduced into the tank and water to be produced was removed. Further, 96 parts by mass of trimellitic anhydride were added to the resultant. The mixture was heated to a temperature of 180° C. and then subjected to a reaction for 2 hours. Thus, a polyester resin 2 having a weight-average molecular weight (Mw) of 84,000 was obtained.

<Production Example of Toner 1>

| | |
|---|---|
| Polyester resin 1 | 80 parts by mass |
| Polyester resin 2 | 20 parts by mass |
| Paraffin wax (melting point: 75° C.) | 7 parts by mass |
| Cyan pigment (C.I. Pigment Blue 15:3 (copper phthalocyanine)) | 5 parts by mass |
| Aluminum 3,5-di-t-butylsalicylate compound | 1 part by mass |

The foregoing materials were mixed well with a Henschel mixer (model FM-75 manufactured by NIPPON COKE & ENGINEERING CO., LTD.). After that, the mixture was kneaded with a biaxial kneader (model PCM-30 manufactured by Ikegai Corp) set at a temperature of 130° C. The resultant kneaded product was cooled and then coarsely pulverized into a size of 1 mm or less with a hammer mill to provide a coarsely pulverized product. The resultant coarsely pulverized product was finely pulverized with an impact type airflow pulverizer using a high-pressure gas.

Next, a fine powder and a coarse powder were simultaneously classified and removed by classifying the resultant finely pulverized product with an air classifier (Elbow Jet Lab EJ-L3 manufactured by Nittetsu Mining Co., Ltd.) utilizing the Coanda effect. Further, the resultant was subjected to surface modification with a mechanical surface-modifying apparatus (Faculty F-300 manufactured by Hosokawa Micron Corporation). At that time, the number of revolutions of a dispersion rotor was set to 7,500 rpm, the number of revolutions of a classification rotor was set to 9,500 rpm, an input was set to 250 g per 1 cycle, and a surface modification time (=cycle time, a time period from the completion of the raw material supply to the opening of a discharge valve) was set to 30 sec. Thus, toner particles 1 were obtained.

Next, 1.0 part by mass of rutile type titanium oxide (number-average particle diameter of primary particles: 20 nm, treated with n-decyltrimethoxysilane), 2.0 parts by mass of a silica A (produced by a vapor phase oxidation method, number-average particle diameter of primary particles: 40 nm, treated with a silicone oil), and 2.0 parts by mass of a silica B (produced by a sol-gel method, number-average particle diameter of primary particles: 140 nm, treated with HMDS) were added to 100 parts by mass of the toner particles 1, and then the contents were mixed with a 5-1 Henschel mixer at a circumferential speed of 30 m/s for 15 minutes. After that, coarse particles were removed with a sieve having an aperture of 45 μm. Thus, a toner 1 was obtained.

<Production Example of Two-Component Developer 1>

8.0 Parts by mass of the toner 1 were added to 92.0 parts by mass of the magnetic carrier 1 and then the contents were mixed with a V type mixer (V-20 manufactured by Seishin Enterprise Co., Ltd.). Thus, a two-component developer 1 was obtained.

<Production Examples of Two-Component Developers 2 to 30>

Two-component developers 2 to 30 were obtained by performing the same operation as that in the production example of the two-component developer 1 except that such a change as shown in Table 6 was made.

<Production Example of Developer for Replenishment 1>

9.0 Parts by mass of the toner 1 were added to 1.0 part by mass of the magnetic carrier 1 and then the contents were mixed with a V type mixer (V-20 manufactured by Seishin Enterprise Co., Ltd.). Thus, a developer for replenishment 1 was obtained.

<Production Examples of Developers for Replenishment 2 to 30>

Developers for replenishment 2 to 30 were obtained by performing the same operation as that in the production example of the developer for replenishment 1 except that such a change as shown in Table 6 was made.

TABLE 6

| | Two-component developer | | | |
|---|---|---|---|---|
| | Two-component developer | Developer for replenishment | Magnetic carrier | Toner |
| Example 1 | 1 | 1 | 1 | 1 |
| Example 2 | 2 | 2 | 2 | 1 |
| Example 3 | 3 | 3 | 3 | 1 |
| Example 4 | 4 | 4 | 4 | 1 |
| Example 5 | 5 | 5 | 5 | 1 |
| Example 6 | 6 | 6 | 6 | 1 |

TABLE 6-continued

| | Two-component developer | | | |
|---|---|---|---|---|
| | Two-component developer | Developer for replenishment | Magnetic carrier | Toner |
| Example 7 | 7 | 7 | 7 | 1 |
| Example 8 | 8 | 8 | 8 | 1 |
| Example 9 | 9 | 9 | 9 | 1 |
| Example 10 | 10 | 10 | 10 | 1 |
| Example 11 | 11 | 11 | 11 | 1 |
| Example 12 | 12 | 12 | 12 | 1 |
| Example 13 | 13 | 13 | 13 | 1 |
| Example 14 | 14 | 14 | 14 | 1 |
| Example 15 | 15 | 15 | 15 | 1 |
| Example 16 | 16 | 16 | 16 | 1 |
| Example 17 | 17 | 17 | 17 | 1 |
| Example 18 | 18 | 18 | 18 | 1 |
| Example 19 | 19 | 19 | 19 | 1 |
| Example 20 | 20 | 20 | 20 | 1 |
| Example 21 | 21 | 21 | 21 | 1 |
| Example 22 | 22 | 22 | 22 | 1 |
| Example 23 | 23 | 23 | 23 | 1 |
| Example 24 | 24 | 24 | 24 | 1 |
| Example 25 | 25 | 25 | 25 | 1 |
| Example 26 | 26 | 26 | 26 | 1 |
| Comparative Example 1 | 27 | 27 | 27 | 1 |
| Comparative Example 2 | 28 | 28 | 28 | 1 |
| Comparative Example 3 | 29 | 29 | 29 | 1 |
| Comparative Example 4 | 30 | 30 | 30 | 1 |

Example 1

A reconstructed apparatus of a printer for digital commercial printing IMAGE RUNNER ADVANCE C9075 PRO manufactured by Canon Inc. was used as an image-forming apparatus. The two-component developer 1 was charged into a developing unit at a cyan position, the developer for replenishment 1 was charged into a bottle for replenishment at the cyan position, and an image was formed and subjected to evaluations to be described later. It should be noted that the printer was reconstructed in point of the following. A rectangular AC voltage having a frequency of 8.0 kHz and a Vpp of 0.7 kV, and a DC voltage $V_{DC}$ were applied to a developer carrying member. At the time of an endurance image output evaluation, the DC voltage $V_{DC}$ of the developer carrying member, the charged voltage $V_D$ of an electrostatic latent image-bearing member, and laser power were adjusted so that the toner laid-on level of an FFh image (solid image) on paper was 0.55 mg/cm$^2$ in order for the toner consumptions to be matched with each other. The "FFh" refers to one of the values obtained by representing 256 levels of gray in hexadecimal notation. 00h corresponds to the first level of gray (white portion) of the 256 levels of gray, and the FFh corresponds to the 256th level of gray (solid portion) of the 256 levels of gray.

Output on 50,000 sheets of A4 paper was performed as an endurance image output test with a band chart for FFh outputting having an image ratio of 40%.

Printing environment A high-temperature, high-humidity environment: under an environment having a temperature of 30° C. and a humidity of 80% RH (hereinafter, abbreviated as "H/H")

Paper Laser beam printer paper CS-814 (81.4 g/m$^2$) (available from Canon Marketing Japan Inc.)

Evaluations were performed based on the following evaluation methods. Table 7 shows the results.

(Maintenance Factor of Q/M (mC/kg))

Q/M on the electrostatic latent image-bearing member before and after the endurance were evaluated. A solid image (FFh) was formed on the electrostatic latent image-bearing member. The rotation of the electrostatic latent image-bearing member was stopped before the image was transferred onto an intermediate transfer member, and then the toner on the electrostatic latent image-bearing member was sucked and collected with a metal cylindrical tube and a cylindrical filter. At that time, an electric charge quantity Q stored in a capacitor through the metal cylindrical tube and the mass M of the collected toner were measured, and then an electric charge quantity per unit mass Q/M (mC/kg) was calculated from the measured values. The calculated value was defined as the Q/M (mC/kg) on the electrostatic latent image-bearing member.

The initial Q/M on the electrostatic latent image-bearing member was defined as 100%, and then the maintenance factor of the Q/M on the electrostatic latent image-bearing member after the endurance was calculated and judged by the following criteria.

A: The maintenance factor of the Q/M on the electrostatic latent image-bearing member is 90% or more (extremely good).

B: The maintenance factor of the Q/M on the electrostatic latent image-bearing member is 80% or more and less than 90% (good).

C: The maintenance factor of the Q/M on the electrostatic latent image-bearing member is less than 80% (unacceptable in the present invention).

(Developability)

Developability before the endurance was evaluated. A solid image (FFh) was formed on the electrostatic latent image-bearing member. The rotation of the electrostatic latent image-bearing member was stopped before the image was transferred onto the intermediate transfer member, and then the toner on the electrostatic latent image-bearing member was sucked and collected with a metal cylindrical tube and a cylindrical filter. At that time, an electric charge quantity Q stored in a capacitor through the metal cylindrical tube and the area S of the image subjected to the collection were measured, and then an electric charge quantity per unit area Q/S ($mC/m^2$) was calculated from the measured values. The developability was evaluated with a value for Q/S/Vcont ($\mu C \cdot s^3 \cdot A \cdot m^{-4} \cdot kg^{-1}$) obtained by dividing the calculated value by a contrast voltage (Vcont).

A: 1.10 or more (extremely good)

B: 1.00 or more and less than 1.10 (good)

C: Less than 1.00 (unacceptable in the present invention)

(Leakage (White Spot))

Leakage after the endurance was evaluated. Solid (FFh) images were continuously output on five sheets of A4 plain paper and then the number of white spots each having a diameter of 1 mm or more in each image was counted. The total number thereof in the five images was calculated and evaluated by the following criteria.

A: 0 (extremely good)

B: 1 or more and less than 6 (good)

C: 6 or more (unacceptable in the present invention)

(Carrier Adhesion)

Carrier adhesion after the endurance was evaluated. The $V_{DC}$ was adjusted so that a Vback was 100 V, followed by the output of an FFh image. The power source of the apparatus was turned off in the midst of the output of the image, and then sampling was performed by causing a transparent adhesive tape to closely adhere onto the electrostatic latent image-bearing member before its cleaning. Then, the number of magnetic carrier particles adhering onto the electrostatic latent image-bearing member in a region measuring 1 cm by 1 cm was counted, followed by the calculation of the number of adhering carrier particles per 1 $cm^2$. The calculated value was evaluated by the following criteria.

A: 1 or less (extremely good)

B: 2 or more and 6 or less (good)

C: 7 or more (unacceptable in the present invention)

Examples 2 to 26 and Comparative Examples 1 to 4

Evaluations were performed in the same manner as in Example 1 except that the two-component developers 2 to 28 were used. Table 7 shows the results of the evaluations.

TABLE 7

Results of evaluations

| | Maintenance factor of Q/M (mC/kg) | | | Developability | | Leakage | | Carrier adhesion | |
|---|---|---|---|---|---|---|---|---|---|
| Example 1 | A | 48→46 | 96% | A | 1.20 | A | 0 | A | 0 |
| Example 2 | A | 47→45 | 96% | A | 1.21 | A | 0 | A | 1 |
| Example 3 | A | 48→45 | 94% | A | 1.20 | A | 0 | B | 2 |
| Example 4 | A | 48→45 | 94% | A | 1.20 | A | 1 | B | 2 |
| Example 5 | A | 49→46 | 94% | A | 1.21 | B | 3 | B | 3 |
| Example 6 | A | 50→46 | 92% | A | 1.14 | B | 2 | B | 2 |
| Example 7 | A | 45→41 | 91% | A | 1.22 | B | 3 | B | 4 |
| Example 8 | A | 50→46 | 92% | B | 1.09 | B | 2 | B | 2 |
| Example 9 | A | 45→41 | 91% | A | 1.22 | B | 4 | B | 5 |
| Example 10 | A | 44→40 | 91% | A | 1.23 | B | 5 | B | 5 |
| Example 11 | A | 47→43 | 91% | A | 1.21 | B | 4 | B | 5 |
| Example 12 | A | 48→44 | 92% | A | 1.17 | B | 4 | B | 6 |
| Example 13 | A | 40→36 | 90% | A | 1.25 | B | 4 | B | 6 |
| Example 14 | A | 39→36 | 92% | A | 1.25 | B | 4 | B | 6 |
| Example 15 | A | 45→41 | 91% | A | 1.16 | B | 3 | B | 4 |
| Example 16 | A | 46→42 | 91% | A | 1.14 | B | 2 | B | 3 |
| Example 17 | A | 45→41 | 91% | A | 1.23 | B | 3 | B | 4 |
| Example 18 | A | 45→41 | 91% | A | 1.23 | B | 4 | B | 5 |
| Example 19 | A | 40→36 | 90% | A | 1.23 | B | 5 | B | 5 |
| Example 20 | A | 47→43 | 91% | A | 1.12 | B | 2 | B | 3 |
| Example 21 | A | 47→44 | 93% | A | 1.23 | B | 3 | B | 3 |
| Example 22 | A | 43→39 | 90% | A | 1.23 | B | 4 | B | 5 |
| Example 23 | B | 45→38 | 84% | B | 1.09 | B | 2 | B | 2 |
| Example 24 | B | 51→45 | 88% | B | 1.06 | B | 2 | B | 2 |
| Example 25 | B | 50→42 | 83% | B | 1.02 | B | 2 | A | 1 |
| Example 26 | B | 45→36 | 80% | A | 1.25 | B | 5 | B | 5 |
| Comparative Example 1 | C | 45→33 | 73% | B | 1.06 | C | 7 | C | 7 |
| Comparative Example 2 | C | 52→40 | 77% | C | 0.95 | B | 2 | B | 2 |
| Comparative Example 3 | C | 48→38 | 79% | B | 1.12 | B | 3 | B | 4 |
| Comparative Example 4 | C | 48→38 | 79% | C | 0.99 | B | 2 | B | 2 |

<Production Example of Developer for Replenishment 31>

A developer for replenishment 31 was obtained by using only the toner 1.

TABLE 8

Two-component developer

| | Two-component developer | Developer for replenishment | Magnetic carrier | Toner |
|---|---|---|---|---|
| Example 27 | 9 | 31 | 9 | 1 |

Example 27

A reconstructed apparatus of a printer for digital commercial printing IMAGE RUNNER ADVANCE C9075 PRO manufactured by Canon Inc. was used as an image-forming apparatus. The two-component developer 9 was charged into a developing unit at a cyan position, the developer for replenishment 31 was charged into a bottle for replenishment at the cyan position, and an image was formed and subjected to the same evaluations as those of Example 1. It should be noted that unlike Example 1, the printer was reconstructed in point of the following as well. A mechanism for discharging a magnetic carrier that became excessive in a developing unit from the developing unit was removed.

Table 9 shows the results of the evaluations.

TABLE 9

| Results of evaluations | | | | | | | | | |
|---|---|---|---|---|---|---|---|---|---|
| | Maintenance factor of Q/M (mC/kg) | | | Developability | | Leakage | | Carrier adhesion | |
| Example 27 | B | 45→38 | 85% | A | 1.22 | B | 4 | B | 5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-017702, filed Jan. 31, 2012, which is hereby incorporated by reference herein in its entirety.

What is claimed is:

1. A magnetic carrier, comprising filled core particles of which pores of porous magnetic core particles are filled with a filling resin composition, and having a surface coated with a coating resin composition, wherein the coating resin composition comprises a coating resin and a carbon black, an amount of the coating resin composition covering the surface of the filled core particles is 2.0 parts by mass or more and 5.0 parts by mass or less with respect to 100.0 parts by mass of the filled core particles; and a particle diameter of the carbon black in the coating resin composition covering the surface of the filled core particles Pv at a maximum frequency in a particle size distribution based on a volume of the carbon black is 1.0 μm or more and 10.0 μm or less, and wherein the coating resin in the coating resin composition has a repeating structural unit derived from a monomer having a cyclic hydrocarbon group.

2. The magnetic carrier according to claim 1, wherein a content of the carbon black is 10.0 parts by mass or more and 30.0 parts by mass or less with respect to 100.0 parts by mass of the coating resin.

3. The magnetic carrier according to claim 1, wherein the coating resin in the coating resin composition comprises a graft polymer.

4. A two-component developer, comprising a magnetic carrier; and a toner, wherein the toner has toner particles, each of which contains at least a binding resin, a coloring agent, and a wax, and inorganic fine powders; and the magnetic carrier comprises the magnetic carrier according to claim 1.

5. A developer for replenishment, comprising a magnetic carrier and a toner, the developer for replenishment being used in an image-forming method including performing image formation while replenishing a developing unit with the developer for replenishment as required and discharging the magnetic carrier that becomes excessive in the developing unit from the developing unit as required, wherein the developer for replenishment contains 2.0 parts by mass or more and 50.0 parts by mass or less of the toner with respect to 1.0 part by mass of the magnetic carrier;

the toner has toner particles, each of which contains at least a binding resin, a coloring agent, and a wax, and inorganic fine powders; and the magnetic carrier comprises the magnetic carrier according to claim 1.

* * * * *